US006800824B1

(12) United States Patent
Slepian et al.

(10) Patent No.: US 6,800,824 B1
(45) Date of Patent: Oct. 5, 2004

(54) CIRCUIT BREAKER INCLUDING FRAME HAVING STOP FOR OPERATING MECHANISM LINK

(75) Inventors: Robert M. Slepian, Murrysville, PA (US); Craig A. Rodgers, Butler, PA (US); Lance Gula, Clinton, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/693,742

(22) Filed: Oct. 24, 2003

(51) Int. Cl.[7] ..... H01H 73/04

(52) U.S. Cl. ..... 200/400; 200/401; 200/244; 200/303; 335/13; 335/202

(58) Field of Search ..... 200/244, 464, 200/400, 401, 307, 337, 334, 303, 296; 335/13, 38, 18, 236, 240, 174, 132, 202

(56) References Cited

U.S. PATENT DOCUMENTS 3,329,913 A 7/1967 Camp
3,863,042 A * 1/1975 Nicol ..... 200/401
4,151,386 A 4/1979 Nicol et al.
4,197,519 A * 4/1980 Grenier ..... 335/175
4,641,001 A * 2/1987 Fujihisa et al. ..... 200/401
4,644,312 A 2/1987 Baines et al.
4,760,226 A * 7/1988 Fasano ..... 200/303
4,929,919 A * 5/1990 Link et al. ..... 335/38
5,264,673 A * 11/1993 Powell ..... 200/401
5,293,016 A * 3/1994 Nar ..... 200/401
5,302,787 A * 4/1994 Edds et al. ..... 200/401
6,492,607 B2 * 12/2002 Bruckert et al. ..... 200/401

* cited by examiner

*Primary Examiner*—Michael A. Friedhofer
(74) *Attorney, Agent, or Firm*—Martin J. Moran

(57) ABSTRACT

A circuit breaker includes a case, a frame fixedly disposed within the case, separable contacts, and an operating mechanism for opening and closing the separable contacts. The frame includes a tab. The operating mechanism includes an operating handle, a closed position, an open position, a linkage, such as a pair of links, having a first end and a second end, and a link pivotally mounted to the case and to the first end of the linkage. The tab of the frame engages and stops movement of the link in the closed position.

21 Claims, 28 Drawing Sheets

FIG. 20
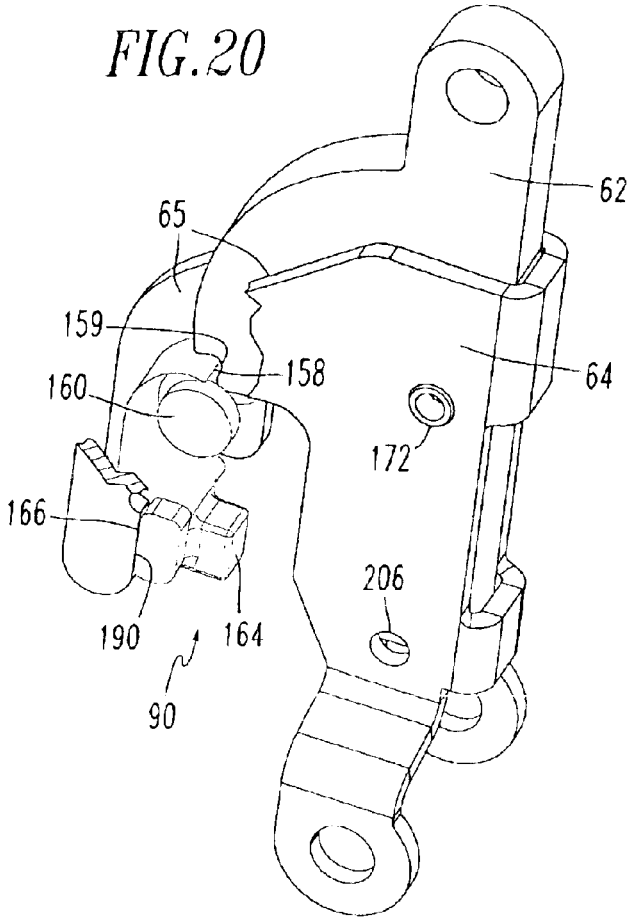
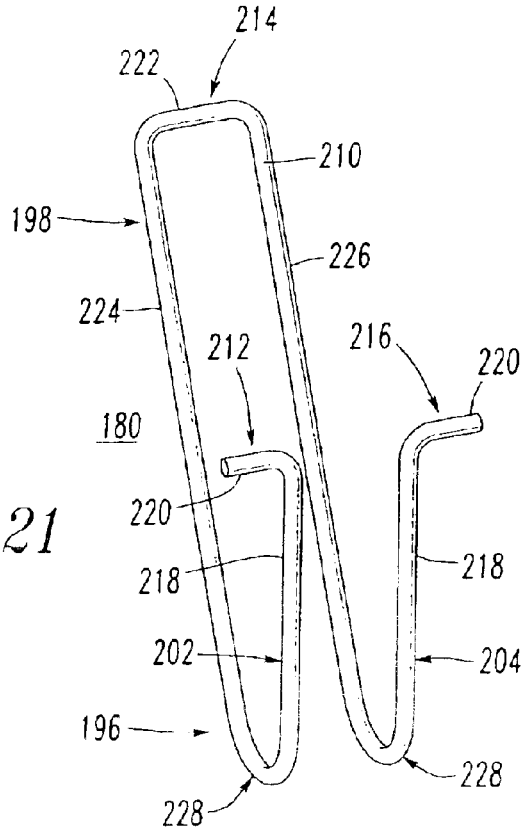
FIG. 21

CIRCUIT BREAKER INCLUDING FRAME HAVING STOP FOR OPERATING MECHANISM LINK

CROSS-REFERENCE TO RELATED APPLICATIONS

This application is related to commonly assigned, concurrently filed:

U.S. patent application Ser. No. 10/693,769, filed Oct. 24, 2003, entitled "Circuit Breaker Including Lock For Operating Mechanism Linkage";

U.S. patent application Ser. No. 10/693,742, filed Oct. 24, 2003, entitled "Circuit Breaker Including Frame Having Stop For Operating Mechanism Link";

U.S. patent application Ser. No. 10/693,768, filed Oct. 24, 2003, entitled "Circuit Breaker Including A Flexible Cantilever Lever For Snap Close Operation";

U.S. patent application Ser. No. 10/693,767, filed Oct. 24, 2003, entitled "Circuit Breaker Including Operating Handle Having One ore More Operating Arms and Extension Springs";

U.S. patent application Ser. No. 10/693,525, filed Oct. 24, 2003, entitled "Circuit Breaker Including Independent Link To Operating Handle";

U.S. patent application Ser. No. 10/693,781, filed Oct. 24, 2003, entitled "Circuit Breaker Including Extension Spring (s) Between Operating Mechanism Pivot And Operating Handle".

BACKGROUND OF THE INVENTION

1. Field of the Invention

This invention relates generally to circuit breakers and, more particularly, to circuit breakers of the electromagnetic type including an operating mechanism and an operating handle.

2. Background Information

Circuit breakers of the electromagnetic type are shown, for example, in U.S. Pat. Nos. 3,329,913, and 4,151,386.

Such electromagnetic circuit breakers typically comprise an operating mechanism including a frame, a movable contact, which is mounted on a movable arm, and a fixed or stationary contact. An operating handle is coupled to the movable arm via a linkage mechanism, part of which comprises a collapsible toggle assembly. The movable and stationary contacts are operated between contacts "open" and contacts "closed" positions by pivoting the operating handle. The circuit breaker further comprises an electromagnetic device which, in response to one or more predetermined electrical conditions, collapses the toggle assembly to a broken state, in order to electrically trip "open" the separable movable and stationary contacts.

In some circuit breakers, the movable arm is connected by a pin to the linkage mechanism, which includes a catch link and a U-link. The catch link is, in turn, connected to an internal extension of the operating handle by a pin. Such circuit breakers employ a stop, in order to prevent the operating mechanism from swinging through its intended travel and pulling the movable contact off the stationary contact at the closed position. The handle stop includes an extension of the frame, which extension engages an end of the operating handle/toggle catch link pin, in order to prevent further travel of the operating handle and, thus, further travel of the handle internal extension, the linkage mechanism, the movable arm and the movable contact.

There is room for improvement in circuit breakers.

SUMMARY OF THE INVENTION

These needs and others are met by the present invention, which provides a tab or stop disposed from the base of a frame to stop one or two independent links in the closed position of the circuit breaker. As these links swing through their movement they contact the tab on its tip and stop. This establishes the ideal position of the operating mechanism and the movable contact arm, in order to position the movable contact with respect to the stationary contact in the closed position. This allows the separable contacts to remain closed and, also, keeps the desired contact force of the operating mechanism.

As one aspect of the invention, a circuit breaker comprises: a case; a frame fixedly disposed within the case, the frame including a stop; separable contacts; and an operating mechanism for opening and closing the separable contacts, the operating mechanism including an operating handle, a closed position, an open position, a linkage having a first end and a second end, and a link pivotally mounted to the case and to the first end of the linkage, the stop of the frame engaging and stopping movement of the link in the closed position.

The frame may include a base and two parallel sides, with the stop attached to the base and being disposed between the parallel sides.

The operating handle may include a pair of elongated arms within the case, the elongated arms being disposed between the parallel sides of the frame, and the stop and the link being disposed between the elongated arms. The operating mechanism may further include a pair of extension springs and a pivot between the link and the first end of the linkage, with each one of the extension springs extending between a corresponding one of the elongated arms and the pivot.

The linkage may include a protrusion, and the stop may engage the protrusion of the linkage and stop movement of the linkage in the open position.

As another aspect of the invention, a circuit breaker comprises: a case; a frame fixedly disposed within the case, the frame including a tab; separable contacts; and an operating mechanism for opening and closing the separable contacts, the operating mechanism including an operating handle, a closed position, an open position, a first link having a first end and a second end, a second link pivotally mounted to the second end of the first link, and a third link pivotally mounted to the case and to the first end of the first link, the tab of the frame engaging and stopping movement of the third link in the closed position.

The frame may include a base and two parallel sides, with the tab disposed from the base and between the parallel sides.

The operating handle may include a pair of elongated arms within the case, the elongated arms being disposed between the parallel sides of the frame, and the tab and the third link being disposed between the elongated arms.

The operating mechanism may further include a pair of extension springs and a pivot between the third link and the first end of the first link, with each one of the extension springs extending between a corresponding one of the elongated arms and the pivot.

The second link may include a protrusion, and the tab may engage the protrusion of the second link and stop movement of the second link in the open position.

BRIEF DESCRIPTION OF THE DRAWINGS

A full understanding of the invention can be gained from the following description of the preferred embodiments when read in conjunction with the accompanying drawings in which:

FIG. 20 is an isometric view of the linkage and lock of FIG. 5 with part of the U-link cut away.

FIG. 21 is an isometric view of the lock bias spring of FIG. 5.

DESCRIPTION OF THE PREFERRED EMBODIMENTS

The invention will be described as applied to a circuit breaker for use in direct current (DC) telecommunication systems (e.g., 60 VDC). It will become evident that the invention is applicable to other types of circuit breakers including those used in alternating current (AC) systems operating at various frequencies; to relatively smaller or larger circuit breakers, such as subminiature or miniature circuit breakers; and to a wide range of circuit breaker applications, such as, for example, residential, commercial, industrial, aerospace, and automotive. As further nonlimiting examples, both AC (e.g., 120, 220, 480–600 VAC) operation at a wide range of frequencies (e.g., 50, 60, 120, 400 Hz) and DC operation (e.g., 42, 60 VDC) are possible.

Figure 1:
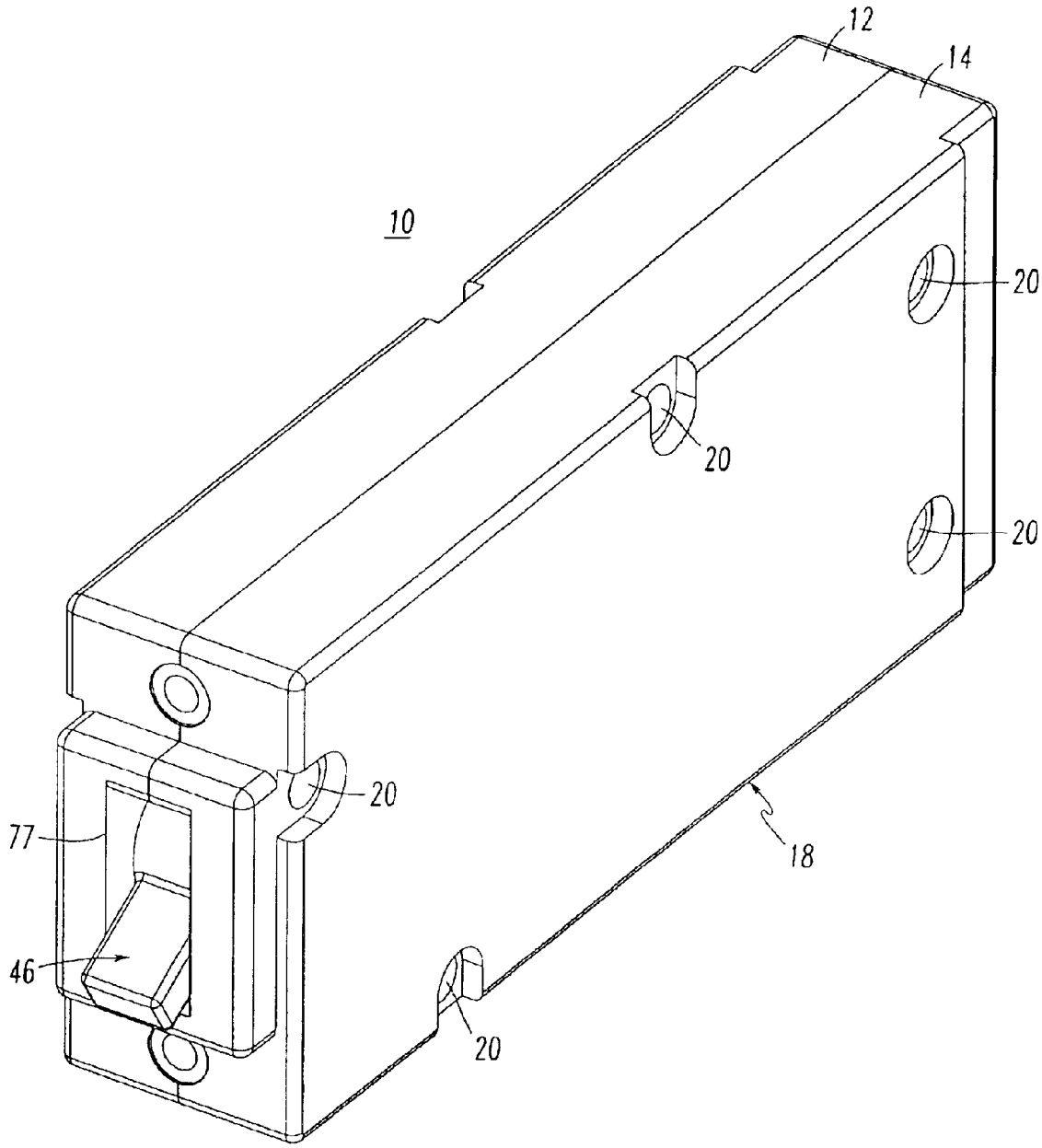
FIG. 1 is an isometric view of a circuit breaker in accordance with the present invention.
Figure 2:
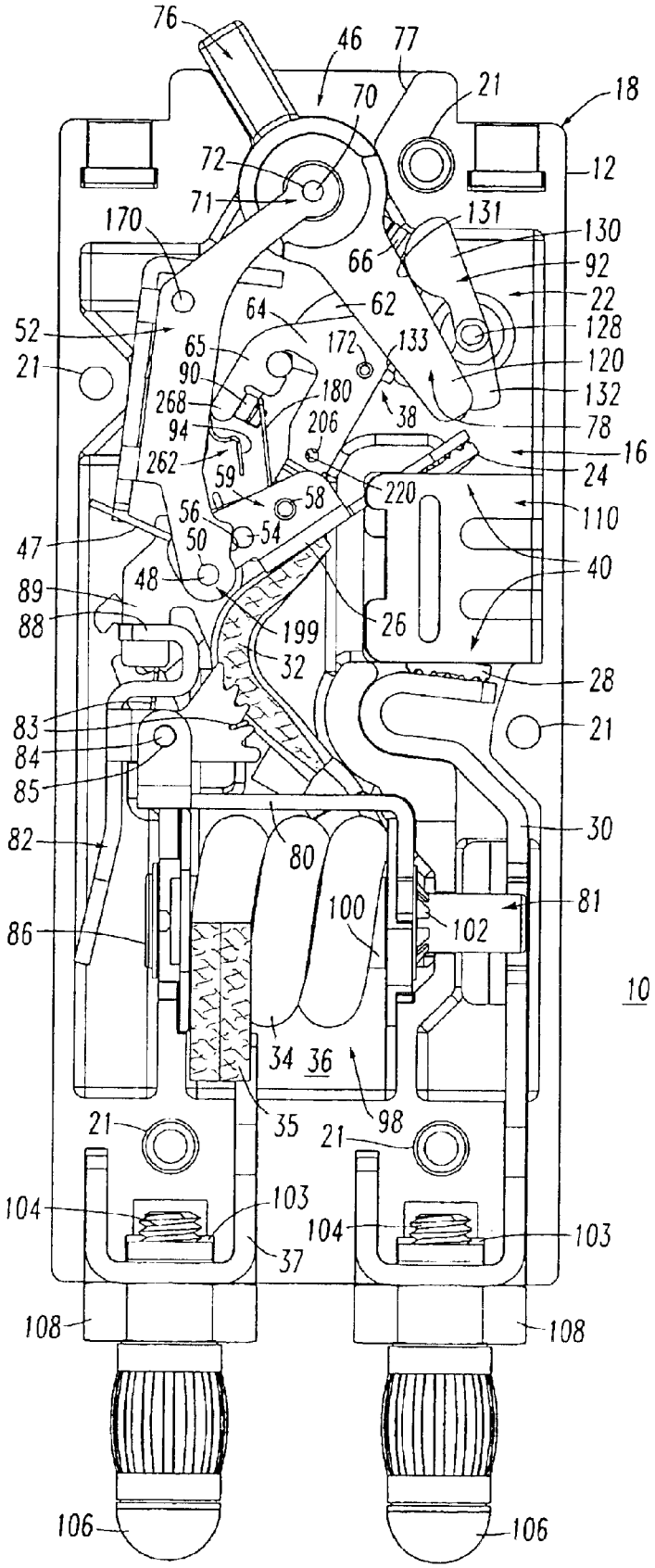
FIG. 2 is a vertical elevation view of the circuit breaker of FIG. 1 with one of the half-cases removed, the operating mechanism being shown in the open position.

Referring to FIGS. 1–6, a circuit breaker 10 includes two approximate half-cases 12,14 forming a main cavity 16 (FIG. 2) of a case 18. The two half-cases 12,14 are secured together by suitable fasteners, such as rivets 20, which pass through holes 21 (FIG. 2) in such half-cases. The main cavity 16 houses an operating mechanism or circuit breaker assembly 22 as shown in FIG. 2. An example of a circuit breaker assembly is described in U.S. Pat. No. 3,329,913, which is incorporated by reference herein.

The exemplary circuit breaker assembly 22 of FIGS. 2–6 and 10 includes a movable contact 24 (shown in FIGS. 2, 6 and 10) carried by a movable contact arm 26 and engageable with a stationary contact 28, the latter carried by a load terminal 30 and fixed within the case 18 of FIG. 1. The movable arm 26 is electrically connected by a flexible conductor, such as braid 32, to one end of a coil 34 forming part of an electromagnetic device 36 (FIG. 2). The other end of the coil 34 is electrically connected by a flexible conductor, such as braid 35 or other suitable conductor, to a line terminal 37.

Figure 31:
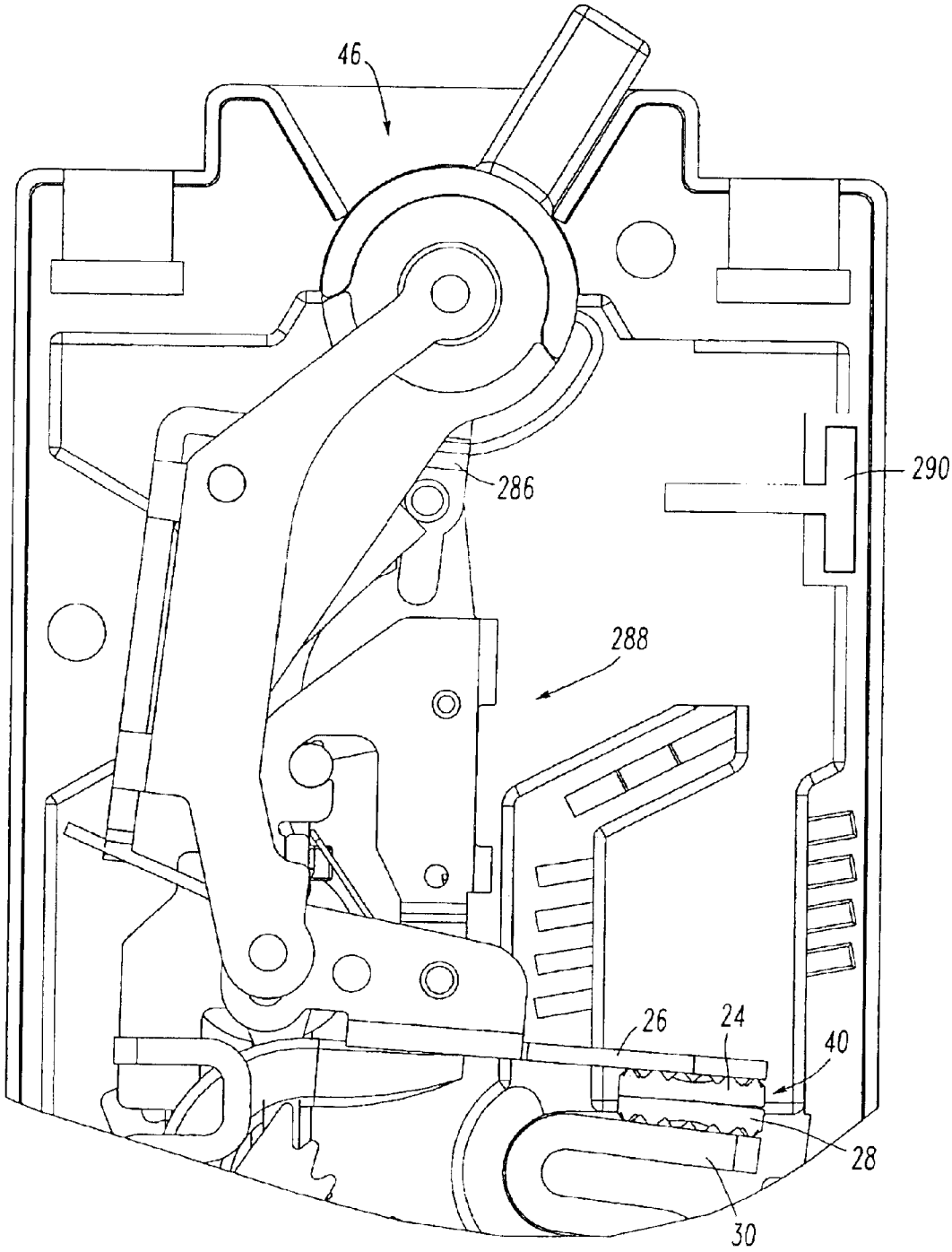
FIG. 31 is a partial vertical elevation view similar to that shown in FIG. 30, but with the operating mechanism being shown in the closed position.

The electromagnetic device 36, in response to one or more predetermined electrical conditions, collapses a linkage mechanism 38 to trip open separable contacts 40 (as shown in an open position in FIG. 2 and in a closed position in FIG. 31) formed by the contacts 24 and 28 housed within the case 18. The contacts 24,28 have a closed position (FIGS. 5 and 31), an open position (FIG. 2), and a tripped open position (FIG. 6), which positions are determined by corresponding positions of the circuit breaker assembly 22. In the closed position, the electrical circuit of the circuit breaker 10 is completed through the line terminal 37, the braid 35, the coil 34, the braid 32, the movable contact arm 26, the movable contact 24, the fixed contact 28, and the load terminal 30.

Figure 6:
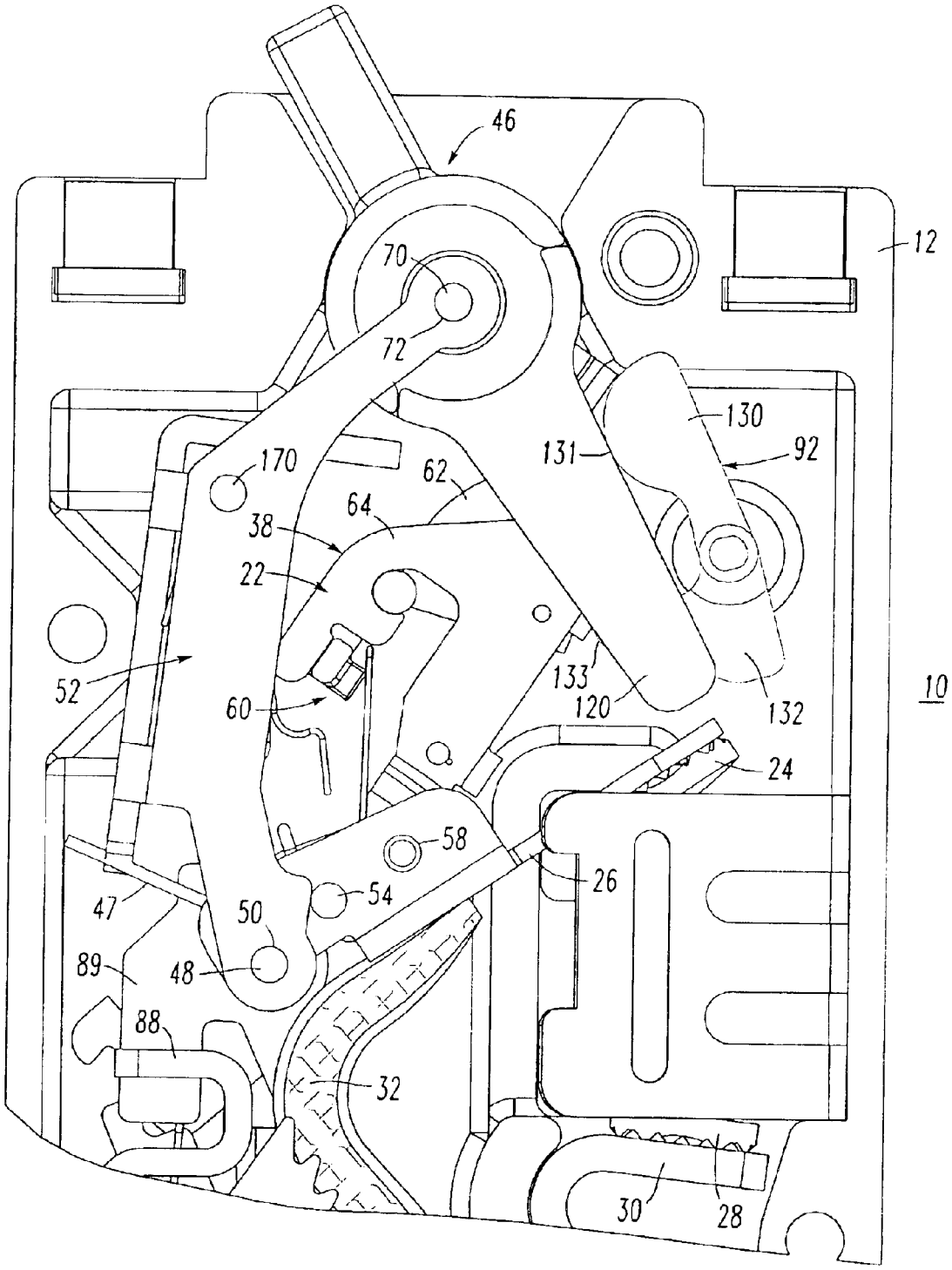
FIG. 6 is a partial vertical elevation view similar to that shown in FIG. 5, but with the operating mechanism being shown in the tripped position.
Figure 7:
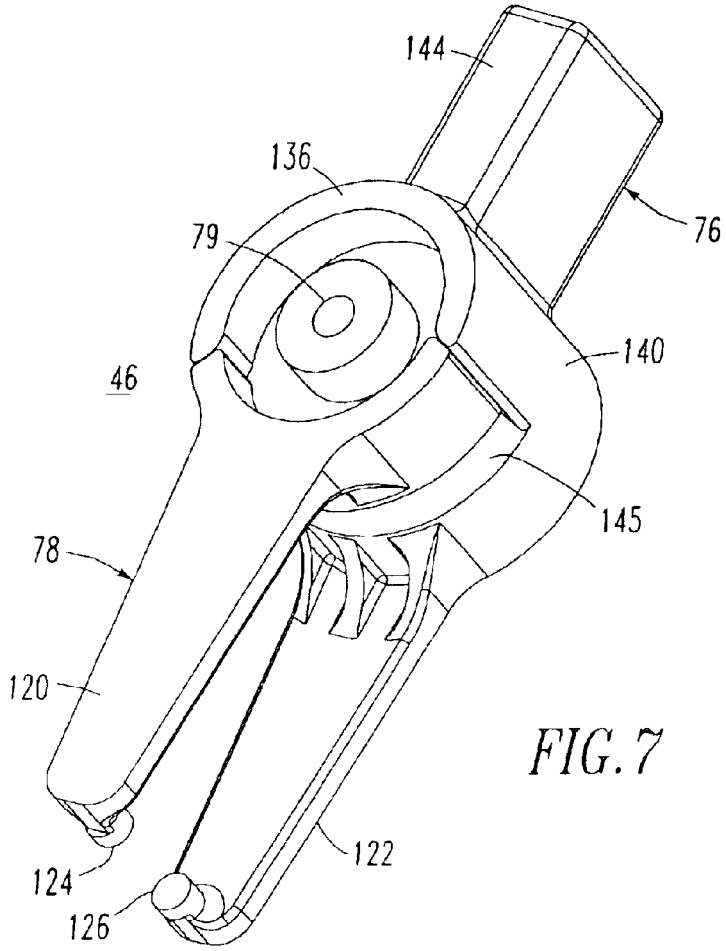
FIG. 7 is an isometric view of the operating handle of FIG. 2.
Figure 8:
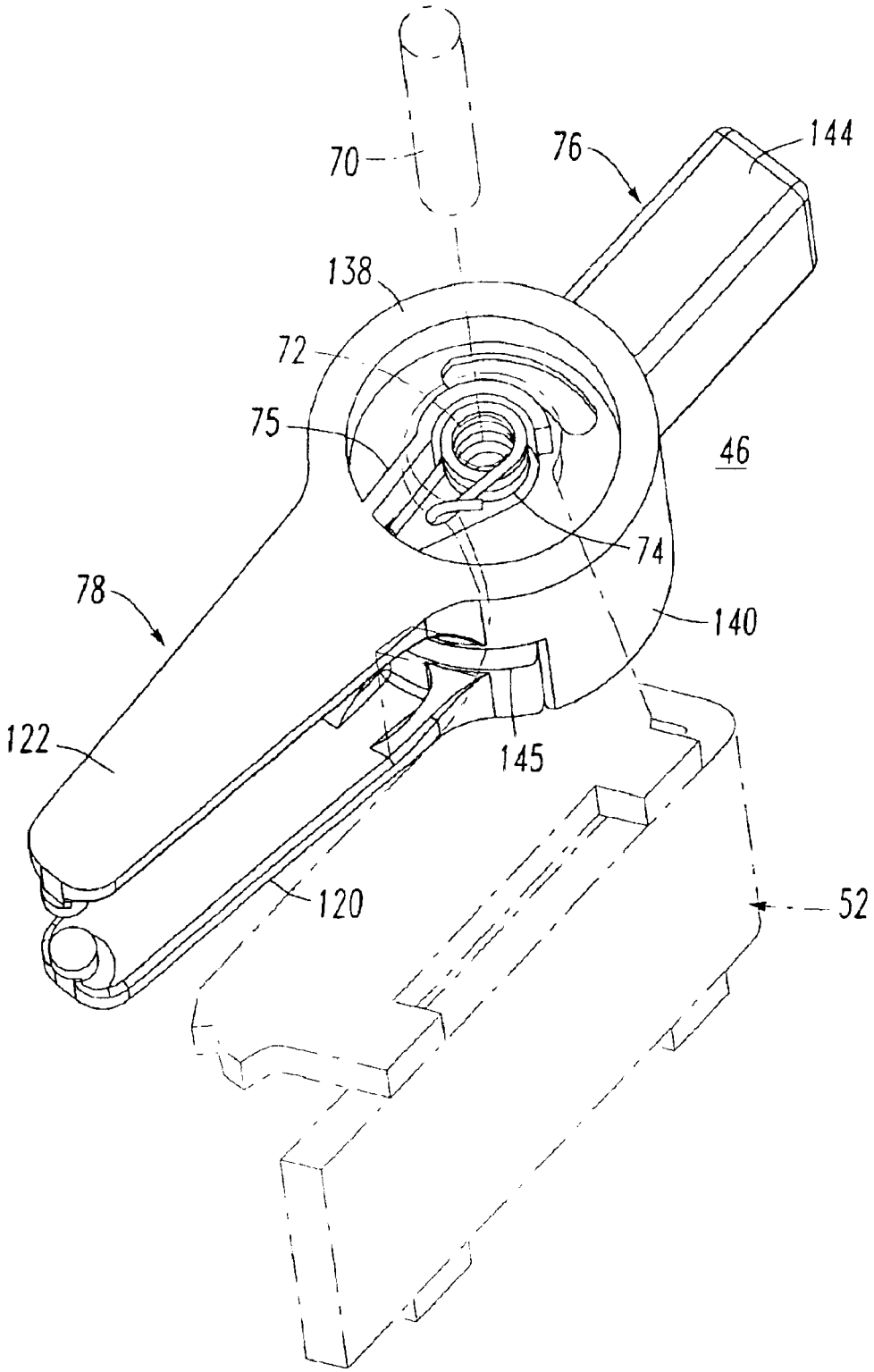
FIG. 8 is an isometric view similar to that shown in FIG. 7, but with the operating handle being reversed to show the surface facing the half-case, and with the frame/handle pin being exploded for clarity of illustration.

The collapsible linkage mechanism 38 is of the type that resets, or relatches, after the separable contacts 40 are tripped open and the operating handle 46 (as best shown in FIGS. 7 and 8) is moved to the off or open position (FIG. 2) by the user. The operating handle 46 has an open position (FIG. 2) corresponding to the open position of the separable contacts 40, a closed position (FIG. 5) corresponding to the closed position of such separable contacts, and a tripped open position (FIG. 6) corresponding to the tripped open position of such contacts.

Figure 22:
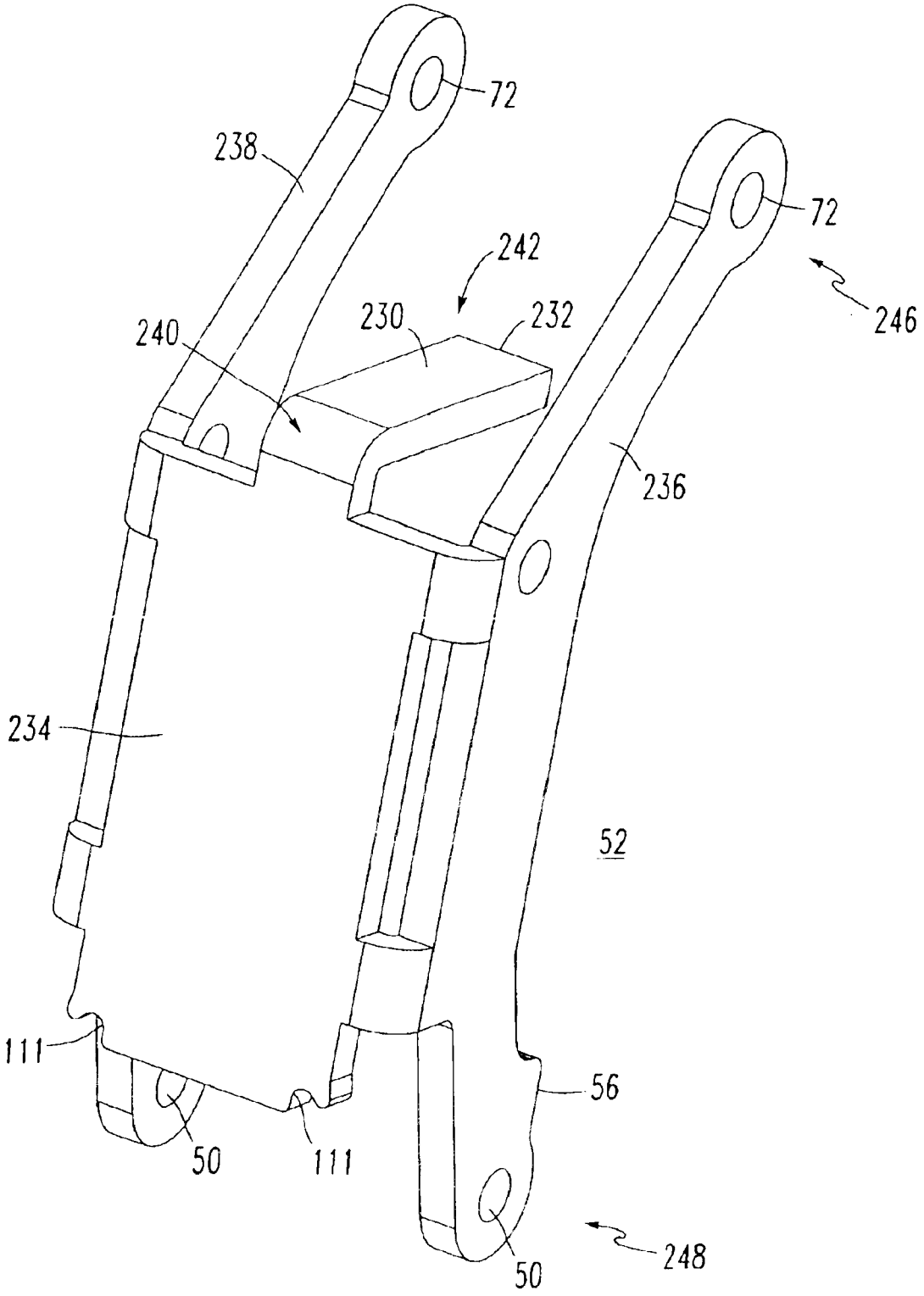
FIG. 22 is an isometric view of the frame of FIG. 2.
Figure 23:
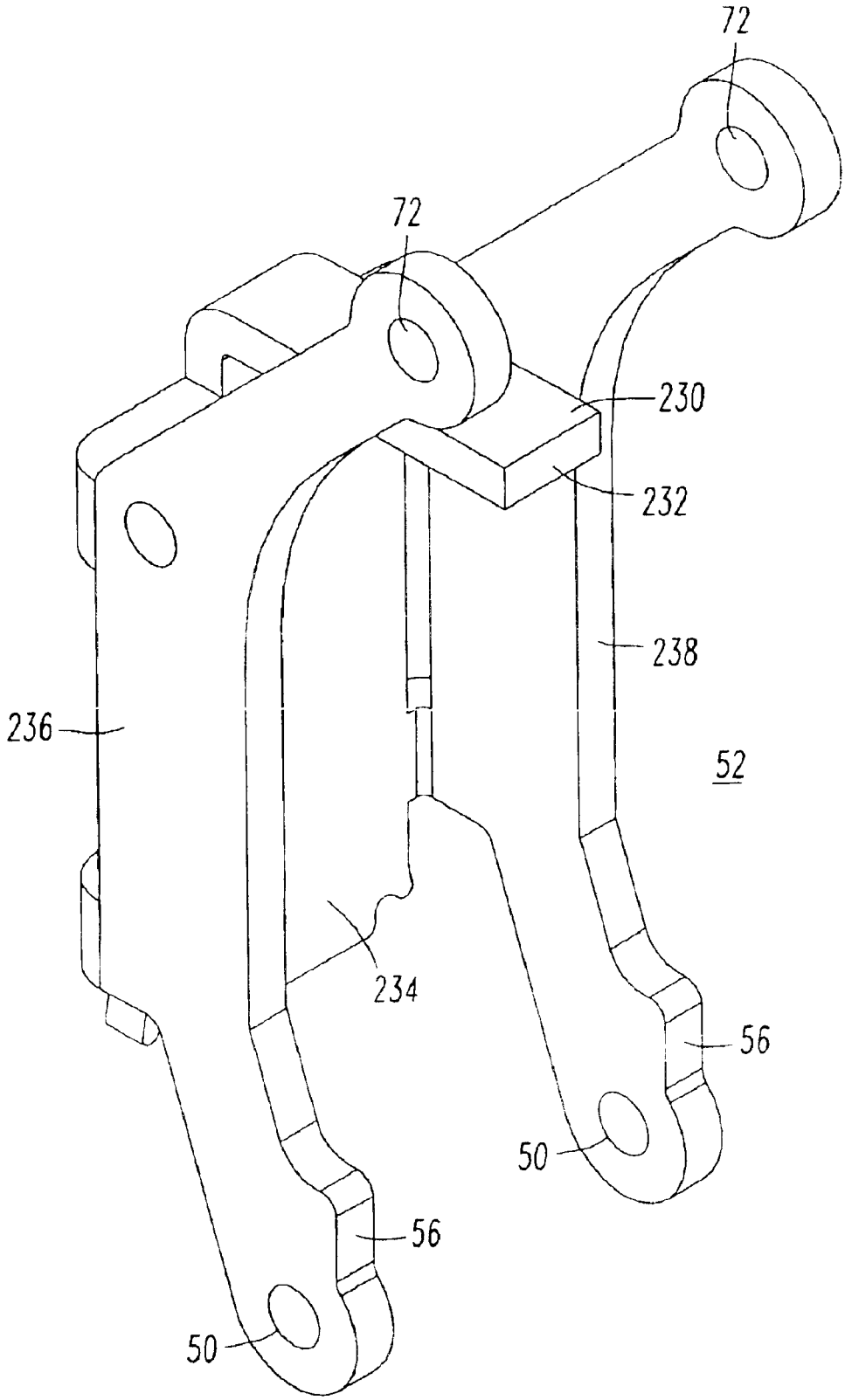
FIG. 23 is an isometric view similar to that shown in FIG. 22, but with the frame being rotated to show the stop surface.

The movable arm 26 is biased by a main torsion spring 47 toward the open position (FIG. 2) of the separable contacts 40. The movable arm 26 is pivotally mounted on a pin 48, which is carried within two openings 50 of a frame 52 (as best shown in FIGS. 22 and 23). The end portions of the pin 48 extend into holes (not shown) formed in the opposed side walls of the half-cases 12 and 14 (FIG. 1) to properly locate and support the assembly 22 inside the case 18. Another pin 54, carried by the movable arm 26, has end portions which engage stop surfaces 56 (as best shown in FIG. 23) of the frame 52, in order to limit the counterclockwise rotation (with respect to FIG. 2) of the arm 26 in its open position. While not shown, it is seen that the stop mechanism provided by the surfaces 56 of FIG. 2 could be formed by projections extending inwardly, for example, from one or both of the half-cases 12,14.

Figure 4:
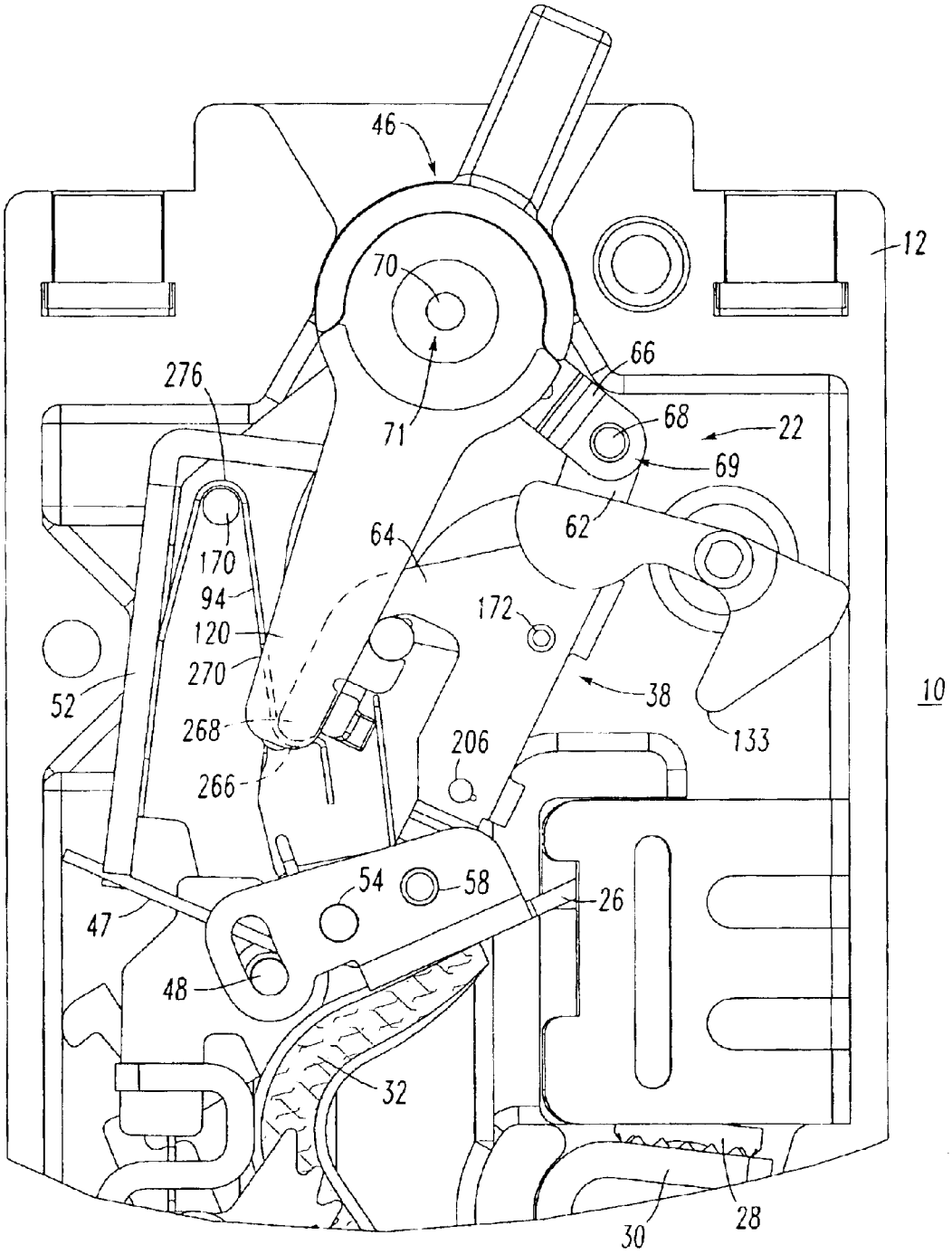
FIG. 4 is a partial vertical elevation view similar to that shown in FIG. 3, but with the frame being partially cut away and the operating handle being moved relatively further toward the closed position as shown prior to the closed position of the operating mechanism.
Figure 11:
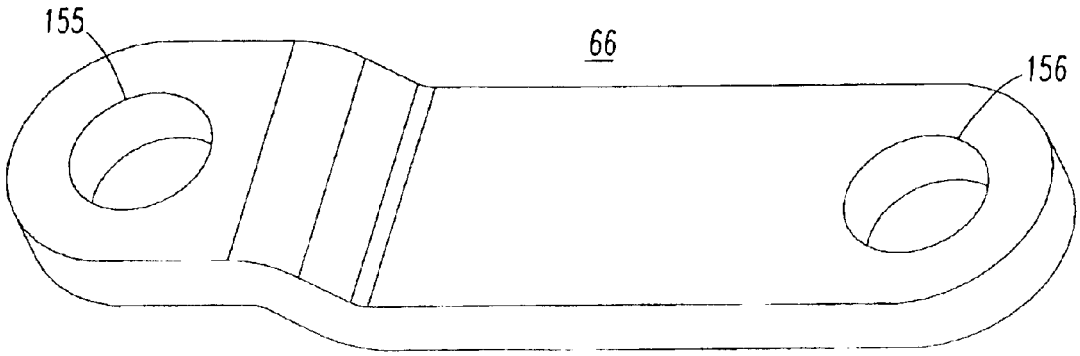
FIG. 11 is an isometric view of the independent handle link of FIG. 2.
Figure 16:
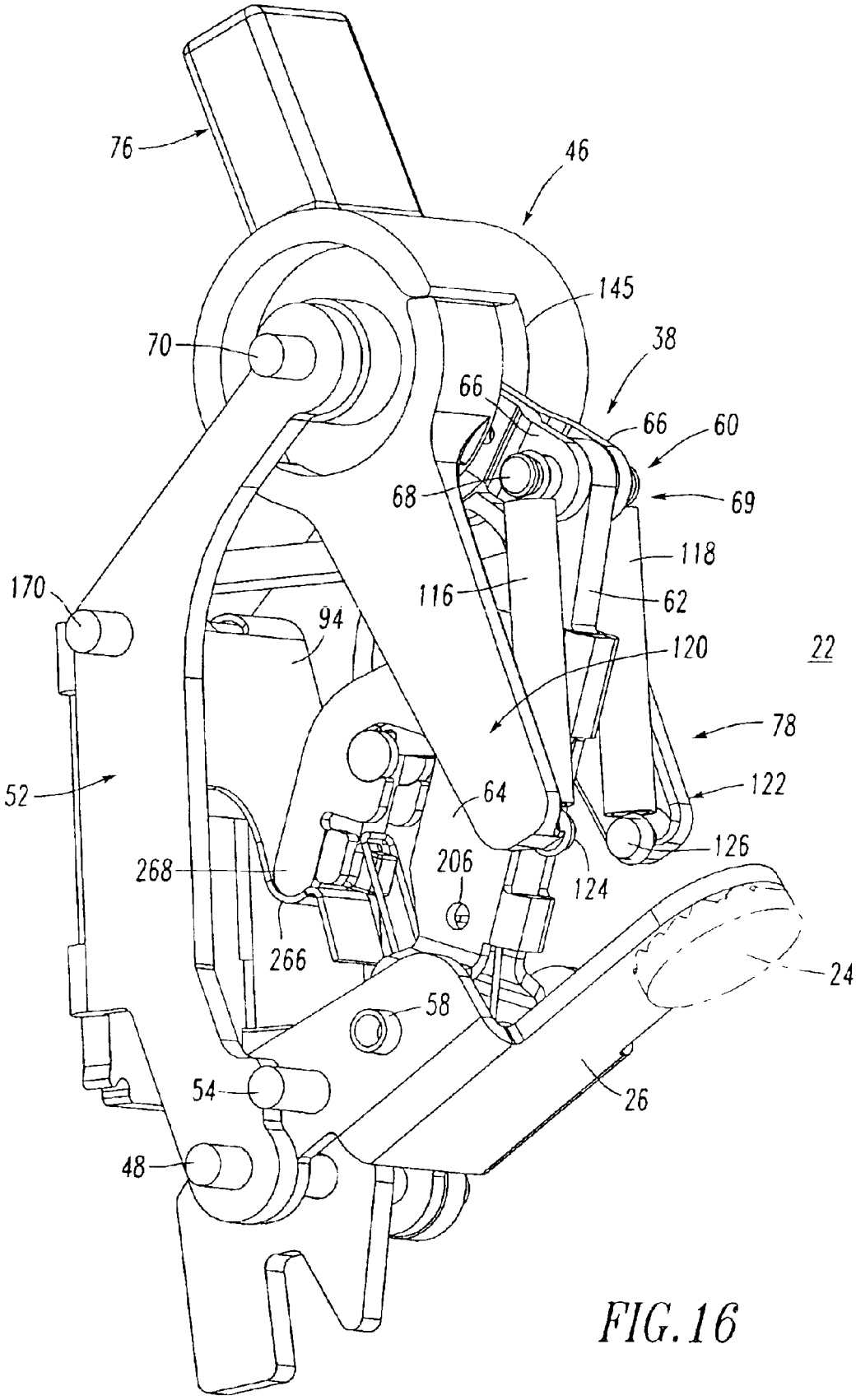
FIG. 16 is an isometric view of the operating mechanism of FIG. 3.
Figure 18:
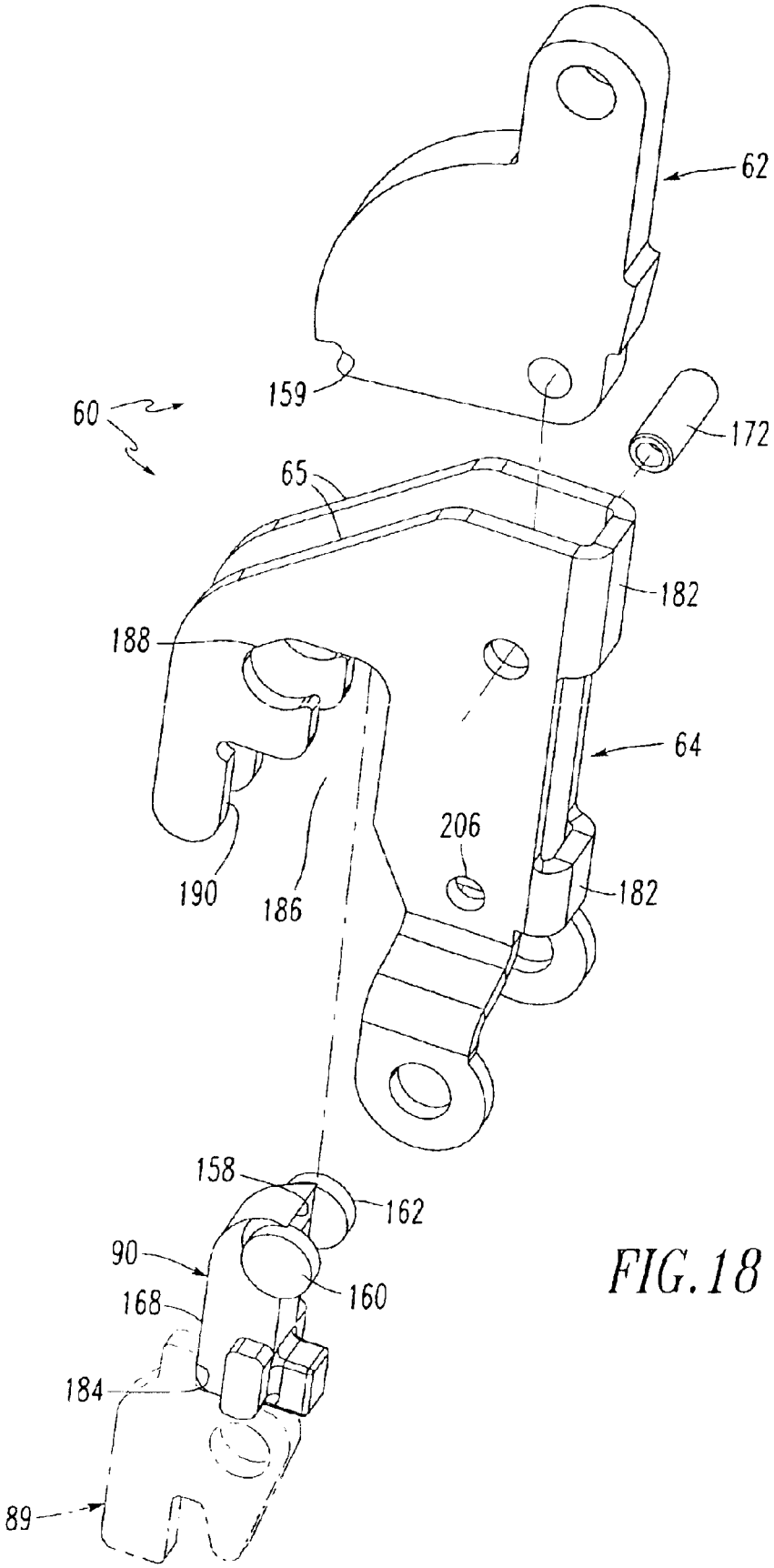
FIG. 18 is an exploded isometric view of the linkage and lock of FIG. 5.

The movable arm 26 is also connected by a U-link/movable contact arm pin 58 to the linkage mechanism 38, which includes a linkage or collapsible toggle assembly 60 (FIG. 18) having a first link or toggle catch link 62 (FIGS. 2 and 18) and a second link or U-link 64 (FIGS. 2 and 18). As shown in FIG. 18, the U-link 64 has a pair of parallel legs 65, one of which is shown in FIG. 2. The linkage mechanism 38 also includes a third link, such as one or two independent handle links 66 (as best shown in FIGS. 11 and 16). The catch link 62 is pivotally connected to the independent handle links 66 by a link/spring pin 68 or first pivot 69 (FIG. 4). The opposite ends of the links 66 are pivotally connected by a pin 70 or second pivot 71 (FIG. 4), which is carried within two openings 72 of the frame 52 (as best shown in FIGS. 22 and 23). The end portions of the pin 70 extend into holes (not shown) formed in the opposed side walls of the half-cases 12 and 14 (FIG. 1) to properly locate and support the links 66 and the operating handle 46 inside the case 18. The pair of links 62,64 has an unbroken state (FIG. 5) corresponding to the closed position of the separable contacts 40 and a broken state (as shown after being substantially reset by the reset lever 92 of FIG. 6) corresponding to the tripped open position of such contacts.

The link/spring pin 68 pivotally connects the pair of independent handle links 66 to the catch link 62. This pin 68 is also the point where two extension springs 116,118 (FIG. 16) are suitably attached (e.g., by having upper (with respect to FIG. 16) end portions wrapped around corresponding ends of the pin 68) to the linkage mechanism 38. The lower (with respect to FIG. 16) end portions of the extension springs 116,118 are suitably attached to (e.g., by being wrapped around) end portions 124,126 of the two elongated arms 120,122, respectively, of the operating handle 46.

The catch link 62 is pivotally mounted at one end to the first pivot pin 68 and is pivotally mounted to the U-link 64 by a catch/U-link fastener 172 (FIG. 18) at the other end of the catch link 62. The pin 58 provides a third pivot 59 between the movable contact arm 26 and the legs 65 of the U-link 64. The links 66 are pivotally mounted to the first pivot pin 68 at one end of such links 66 and are pivotally mounted to the pin 70 for the operating handle 46 of the operating mechanism 22 at the other end of such links 66. In the exemplary embodiment, the operating handle 46 also pivots about the pin 70.

As shown in FIG. 8, a spring 74 is coiled about the pin 70 (shown in phantom line drawing) of FIG. 2 and has one end biased by the frame 52 (shown in phantom line drawing) and another end in contact with a surface 75 of the handle 46. The spring 74 is stressed at all times in order to bias the handle 46 in the counterclockwise direction (with respect to FIG. 2) to the open position (circuit breaker "off"). As shown in FIG. 2, the operating handle 46, which is employed to manually operate the operating mechanism 22, includes a first or handle portion 76 extending through an opening 77 of the case 18, a second or internal portion 78 within the case 18, and an opening 79 (FIG. 7) for the pivot pin 70 between the portions 76,78. As the pivotable handle 46 is moved from the open position (FIG. 2) to the closed position (FIG. 5), the toggle assembly 60 and the movable arm 26 all move down (with respect to FIG. 2), against the bias of the spring 47, and move the movable contact 24 into engagement with the fixed contact 28 achieving the closed (circuit breaker "on") position as shown in FIG. 5.

Figure 5:
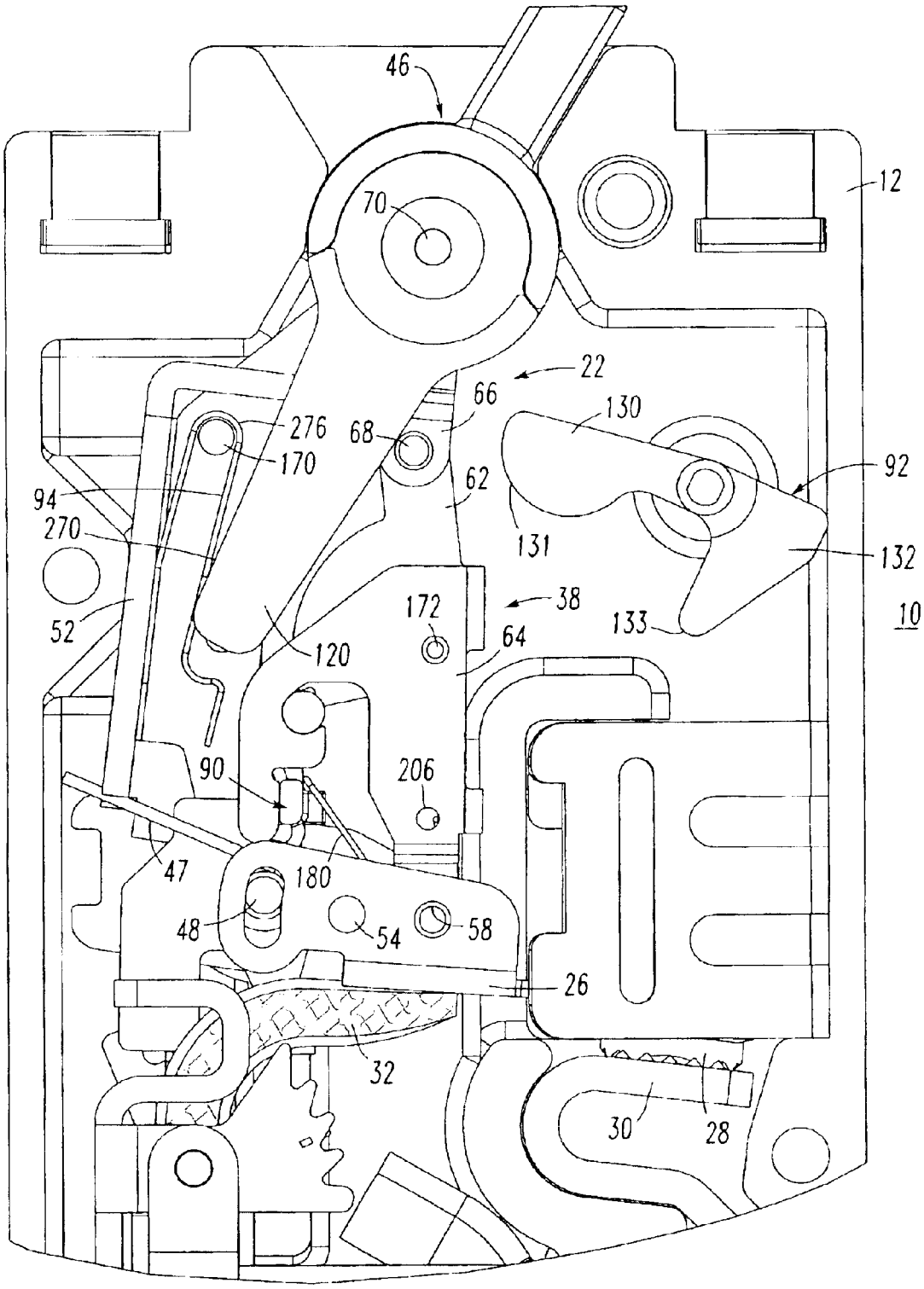
FIG. 5 is a partial vertical elevation view similar to that shown in FIG. 4, but with the operating mechanism being shown in the closed position.

After tripping of the linkage mechanism 38 in response to an overload, for example, the handle spring 74 automatically moves the handle 46 from the closed position of FIG. 5, toward the open position of FIG. 2, and to the tripped open position of FIG. 6 with the toggle assembly 60 in the broken state. When the handle 46 is manually moved from the tripped open position to the open position, or if suitable spring force exists in the spring (not shown) of the operating handle 46, the toggle assembly 60 is relatched (as discussed below in connection with the reset cam or lever 92 of FIG. 2). Although the handle tripped open position of FIG. 6 is almost the same as the handle off position of FIG. 2, a different tripped open position (e.g., central handle position) may be employed. Alternatively, with appropriate spring forces, the tripped open position is the same as the off position, and no manual intervention is needed to relatch the toggle assembly 60.

Continuing to refer to FIG. 2, a motor frame 80 forms a part of the electromagnetic device 36 to which may be secured a time delay motor tube 81 housing a spring biased magnetizable core (not shown) movable against the retarding action of a suitable fluid (e.g., oil) (not shown) to provide a time delay before tripping of the mechanism 22 on certain overloads. The operation of the electromagnetic device 36 is specifically set forth in U.S. Pat. No. 3,329,913 and for purposes of brevity it will only be generally described herein in connection with the present circuit breaker 10.

The electromagnetic device 36 includes a pivotable steel armature 82 and an armature spring 83, which is disposed about an armature main spring pin 84. The armature 82 pivots on the armature main spring pin 84 whose end portions are carried within suitable holes 85 (only one hole is shown) in the frame 80. The armature 82 is biased clockwise (with respect to FIG. 2) by the armature spring 83 whose end portions engage the frame 80 and a portion of the armature 82. Upon the occurrence of a predetermined overload condition, such as one or more selected conditions of current flowing through the separable contacts 40, assuming the circuit breaker 10 to be in the closed position (FIG. 5), the armature 82 is attracted toward a pole piece 86, either after a time delay period or virtually instantaneously, depending on the overload condition. The movement of the armature 82 toward the pole piece 86 causes the oppositely extending trip finger 88, which is integral with the armature 82, to pivot counterclockwise (with respect to FIGS. 2 and 6) and engage and pivot a motion translator or catch 89.

The motion translator 89 is the link between the armature 82, which is attracted to the pole piece 86, and the lock 90 (FIGS. 14 and 18–20). The motion translator 89 reverses the direction of rotation of the armature 82 and acts on the lock 90, in order to unlatch and trip the circuit breaker 10. In particular, the pivotable catch 89 responsively pivots clockwise (with respect to FIGS. 2 and 6) and engages, pivots and trips the lock 90 forming part of the linkage mechanism 38. In turn, the toggle assembly 60 collapses and the movable arm 26 moves upward under the bias of the spring 47 to open the separable contacts 24,28 as shown in FIG. 6. The collapsing motion of the toggle assembly 60 is independent of the position of the handle 46, which is then moved to the tripped open position of FIG. 6.

Still referring to FIG. 2, the operating mechanism or circuit breaker assembly 22 includes the movable contact arm 26, the frame 52, the operating handle 46, the linkage mechanism 38, a reset cam or lever 92, a snap lever 94, the pair of extension springs 116,118 (FIG. 16), and a trip mechanism 98 formed by the electromagnetic device 36. The lock 90 of the linkage mechanism 38 maintains the unbroken state (FIG. 20) of the links 62,64 in the closed position (FIG. 5) of the separable contacts 40. The lock 90 pivots counterclockwise (with respect to FIG. 20) in response to the clockwise (with respect to FIG. 2) motion of the catch 89 of the trip mechanism 98. In turn, the lock 90 releases the links 62,64 to the broken state (FIG. 6) thereof.

The electromagnetic device 36 further includes a bobbin/spool 100, which is supported by the motor frame 80, and on which are disposed the windings of the coil 34. An internal tooth lock washer 102 holds the time delay motor tube 81 with respect to the motor frame 80.

The line and load terminals 37,30 further include threaded openings 103, which accept the threads 104 of bullet terminals 106, which are secured in place by nuts 108.

As is conventional, an arc chute 110 having a plurality of parallel slots (not shown) is preferably employed to extinguish an arc extending between the contacts 24,28.

The main torsion spring 47 is disposed about the frame/movable contact arm pin 48, with one or more legs (only one leg is shown) of the spring 47 engaging the frame 52 at corresponding recesses 111 of FIG. 22 and another portion (only the tip is shown) of the spring 47 engaging the pin 54 in the movable contact arm 26, thereby biasing the movable contact arm 26 toward the open position of the separable contacts 40. The operating mechanism 22 also includes a contact overtravel spring (not shown), which is disposed about the pin 54 in the movable contact arm 26, with one leg of such spring engaging the movable contact arm 26 and the other leg of such spring engaging the U-link 64, thereby biasing the contact arm 26 toward the closed position of the operating mechanism 22, in order to minimize contact bounce.

As best shown in FIG. 16, the exemplary operating mechanism 22 further includes the pivot 69 formed by the pivot pin 68. The internal portion 78 of the operating handle 46 includes the elongated arms 120,122 within the case 18 of FIG. 1. The two extension springs 116,118 extend between the end portions 124,126 of the arms 120,122, respectively, and the pivot 69. The end portions 124,126 are disposed on the ends of the respective elongated arms 120,122 opposite the handle portion 76. Each of the extension springs 116,118 extends on opposite sides of the U-link 64 between a corresponding one of the arms 120,122 of the operating handle 46 and the first pivot pin 68. Although two extension springs 116,118 and two elongated arms 120,122 are disclosed, one (e.g., the spring 116 or 118 may be removed; the arm 120 or 122 may be removed), two or more sets of suitable spring and arm mechanisms may be employed, with each one of the one or more spring mechanisms extending between a corresponding arm mechanism and a pivot. Alternatively, any suitable spring, such as a torsion spring or compression spring, may be employed.

Figure 12:
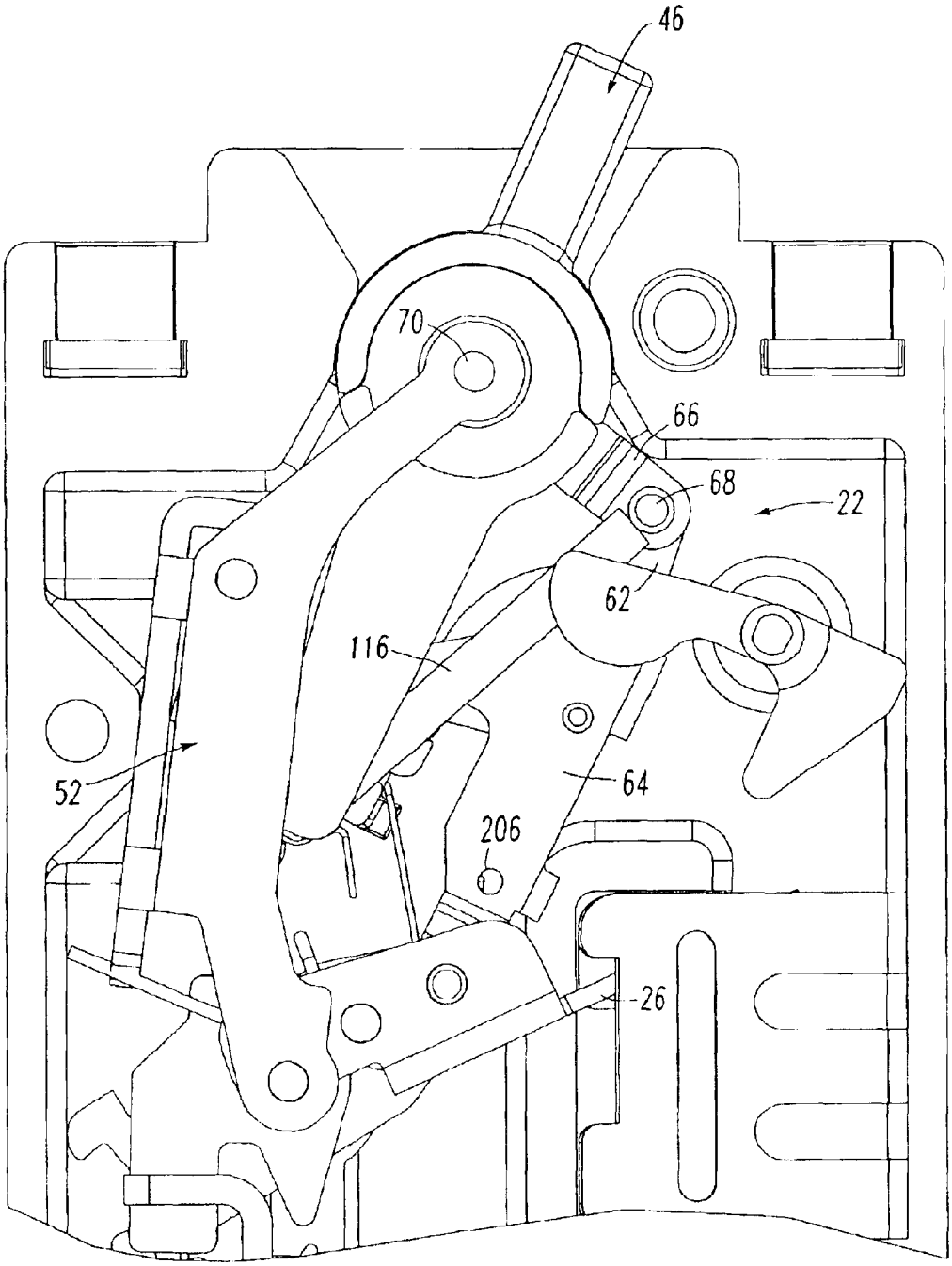
FIG. 12 is a partial vertical elevation view similar to that shown in FIG. 4, but showing the frame and one of the handle extension springs.
Figure 13:
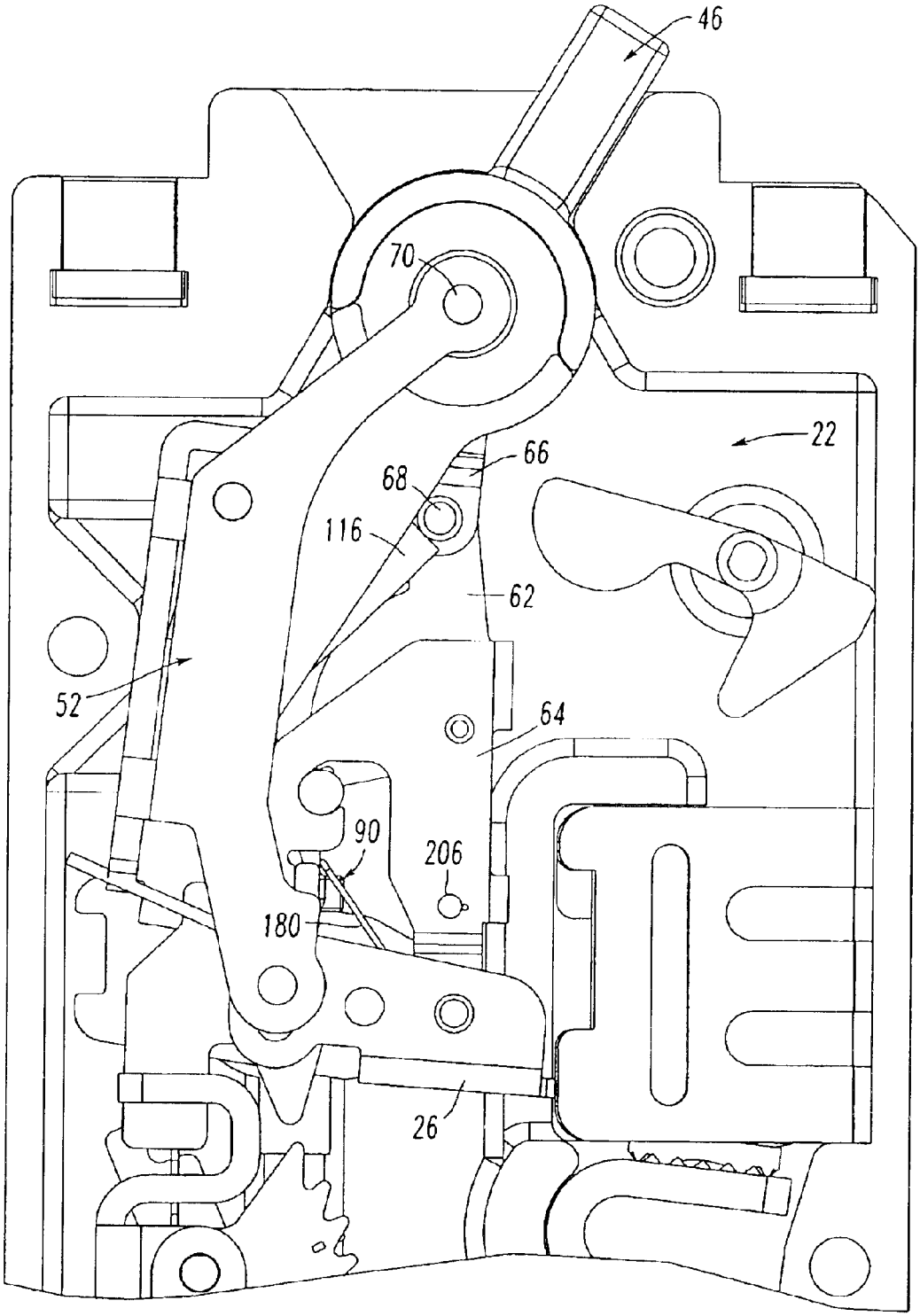
FIG. 13 is a partial vertical elevation view similar to that shown in FIG. 12, but with the operating mechanism being shown in the closed position.

The extension springs 116,118 move the operating mechanism 22 to close the separable contacts 40 by providing a suitable force between the end portions 124,126 of the operating handle 46 and the pivot 69 of the operating mechanism 22. The extension springs 116,118 extend as the operating handle 46 moves from the open position (FIG. 2) toward the closed position (FIGS. 5 and 13) thereof (as best shown with the spring 116 (only one spring is shown) in FIG. 12), in order to suitably load the links 62,64 of the operating mechanism 22.

The reset cam or lever 92 of FIG. 2 is pivotally mounted to the half-cases 12,14 by a pin 128 and includes a first arm 130 and a second arm 132. In the exemplary embodiment, the lever 92 is a molded piece and the pin 128 is formed as two protrusions (only one protrusion is shown in FIG. 2 for the half-case 14 of FIG. 1) on either side, which protrusions pivot in recesses (not shown) in the half-cases 12,14. The arm 120 of the operating handle 46 engages a surface 131 of the first arm 130 of the reset lever 92 as the operating handle 46 moves from the tripped open position (FIG. 6) to the open position (FIG. 2) thereof. The reset lever 92 responsively pivots (clockwise with respect to FIG. 2) and moves its second arm 132 having a surface 133, which engages and pivots the catch link 62, in order to move the links 62,64 from the broken state (FIG. 6) to the unbroken state (FIG. 2) thereof. With reference to FIGS. 5 and 6, a spring (not shown) biases the reset lever 92 counterclockwise (with respect to FIGS. 2, 5 and 6), in order to pivot the first arm 130 and the surface 131 toward the arm 120 of the operating handle 46 in the tripped open position thereof.

Referring to FIGS. 7 and 8, one example of the operating handle 46, which is made of molded plastic, is shown. The first or handle portion 76 of the operating handle 46 has a first side 136, a second side 138, a generally cylindrical surface 140, the opening 79 passing between the first and second sides 136,138, a handle member 144 disposed on the generally cylindrical surface 140, and an opening 145 to receive the upper (with respect to FIG. 2) end of the links 66. The second portion 78 of the operating handle 46 includes the elongated first arm 120 disposed from the first side 136 and the elongated second arm 122 disposed from the second side 138. As best shown in FIG. 16, the elongated first and second arms 120,122 are disposed on opposite sides of the U-link 64.

Figure 9:
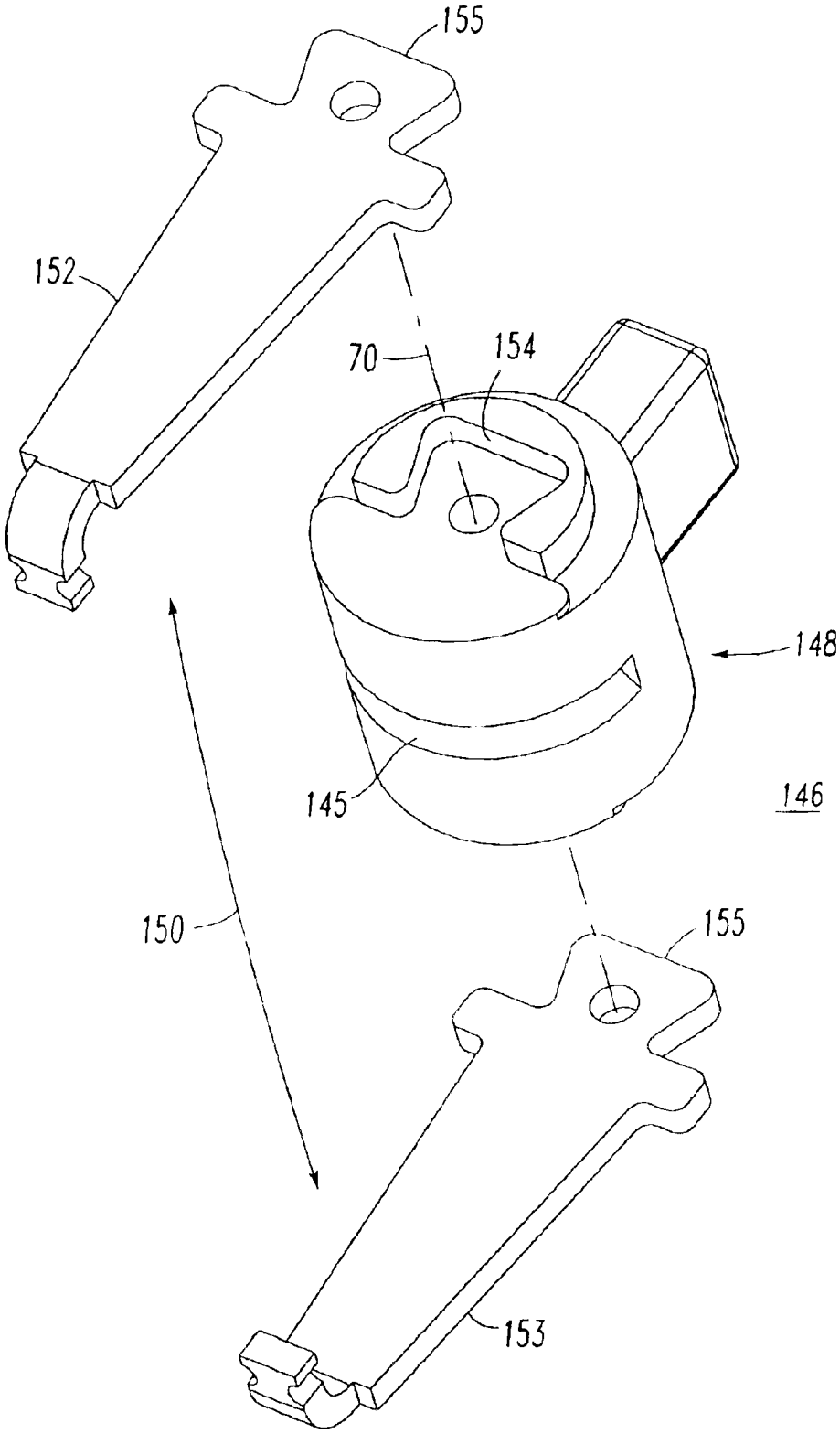
FIG. 9 is an exploded isometric view of an operating handle in accordance with another embodiment of the invention.
Figure 10:
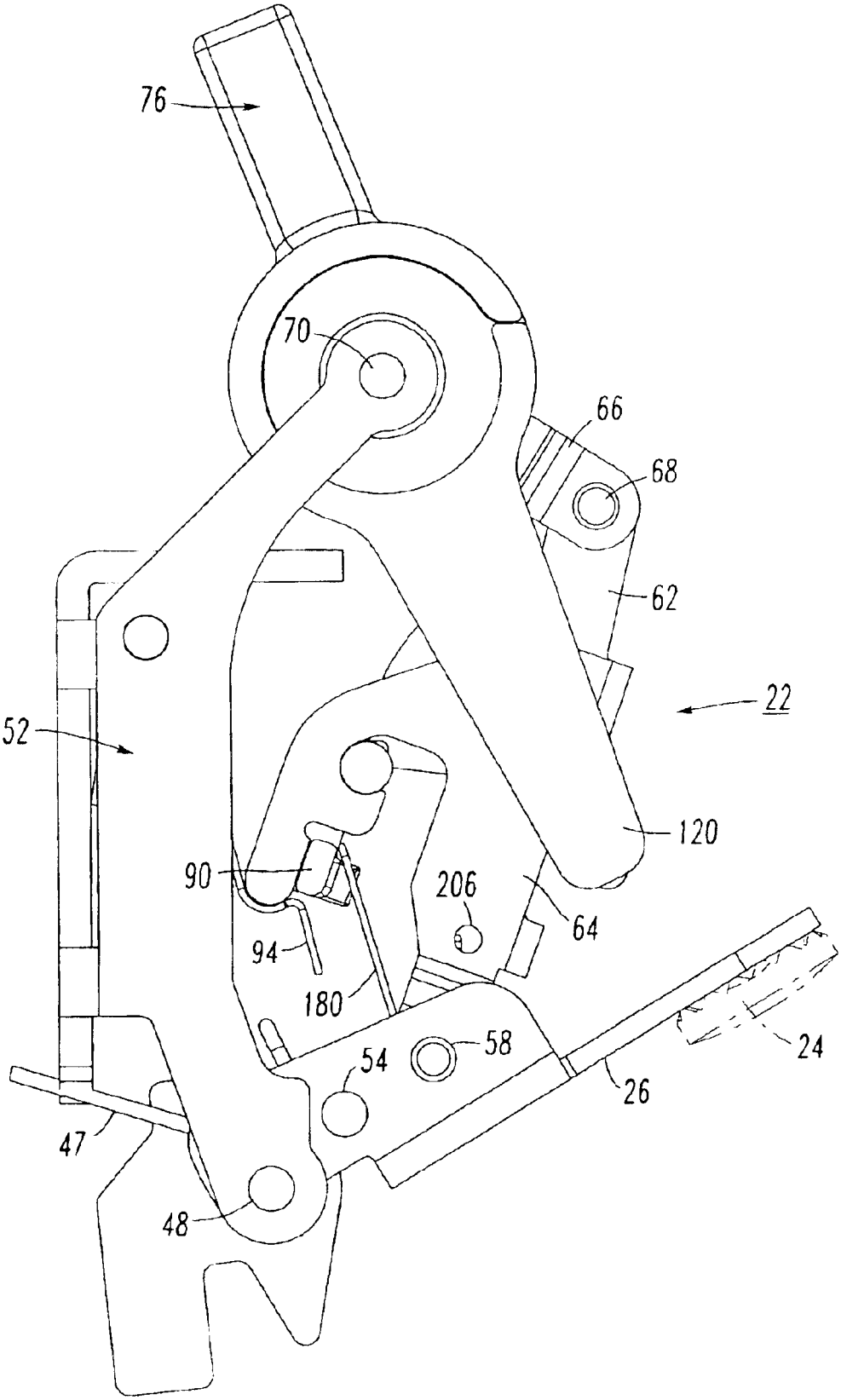
FIG. 10 is a vertical elevation view of the operating mechanism of FIG. 3.

FIG. 9 shows another operating handle 146 including a first portion 148, which is made of molded plastic, and an elongated second portion 150 having a pair of elongated first and second arms 152,153, which are made of steel. The operating handle 146 functions in the same manner as the operating handle 46 of FIGS. 2–8. The molded portion 148 includes the opening 145 for the upper (with respect to FIG. 2) end of the links 66 and a pair of recesses 154 (only one recess is shown), in which corresponding mating portions 155 of the arms 152,153 are suitably engaged (e.g., press fit). Although two exemplary operating handles 46,146 are disclosed, a wide range of operating handles employing one or more arms and made of a wide range of materials may be employed.

Referring to FIG. 11, the independent handle link 66 of FIG. 2 is shown. As shown in FIG. 16, the operating mechanism 22 includes a pair of the parallel links 66, each of which has an opening 155 at one end for pivotal mounting by the pivot pin 68 to the upper end (with respect to FIG. 16) of the catch link 62, and an opening 156 at the other end for pivotal mounting by the pivot pin 70 for the operating handle 46.

Figure 14:
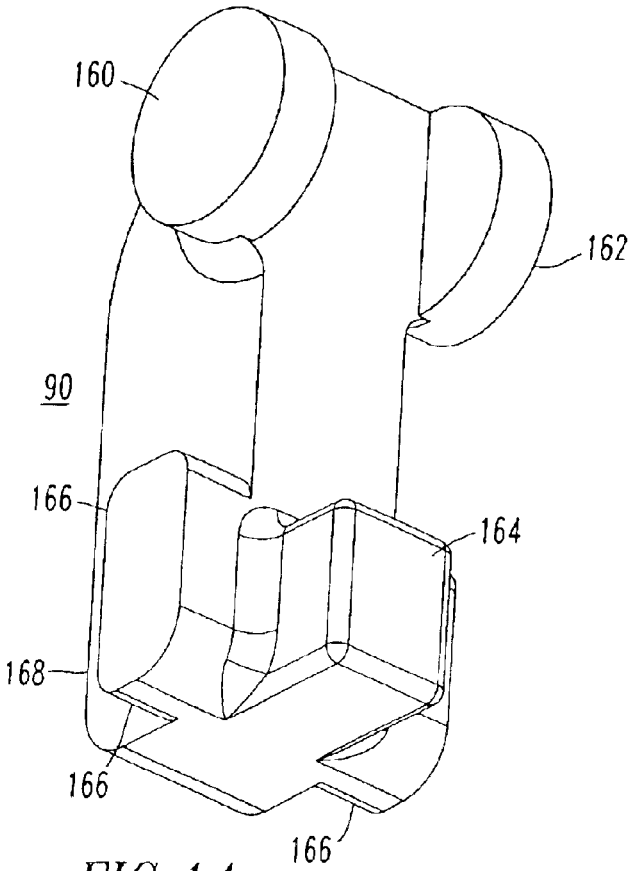
FIG. 14 is an isometric view of the lock of FIG. 5.
Figure 15:
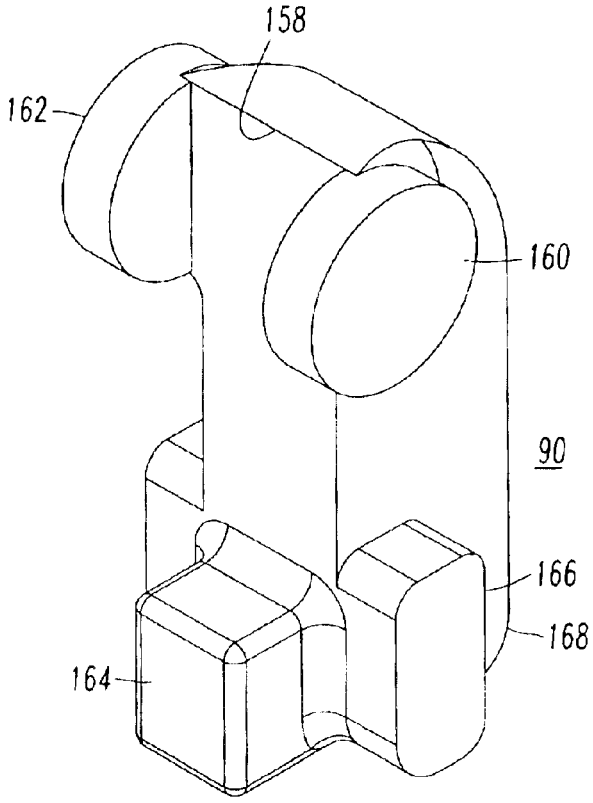
FIG. 15 is an isometric view similar to that shown in FIG. 14, but with the lock being rotated to show the latch surface.

FIGS. 14 and 15 show the lock 90 of FIG. 2, with FIG. 15 showing a latch surface 158 which engages a mating surface 159 of the catch link 62 of FIG. 18. The lock 90 also includes a pair of ears 160,162, a protrusion 164, a pair of stop surfaces 166 and a trip surface 168.

Figure 17:
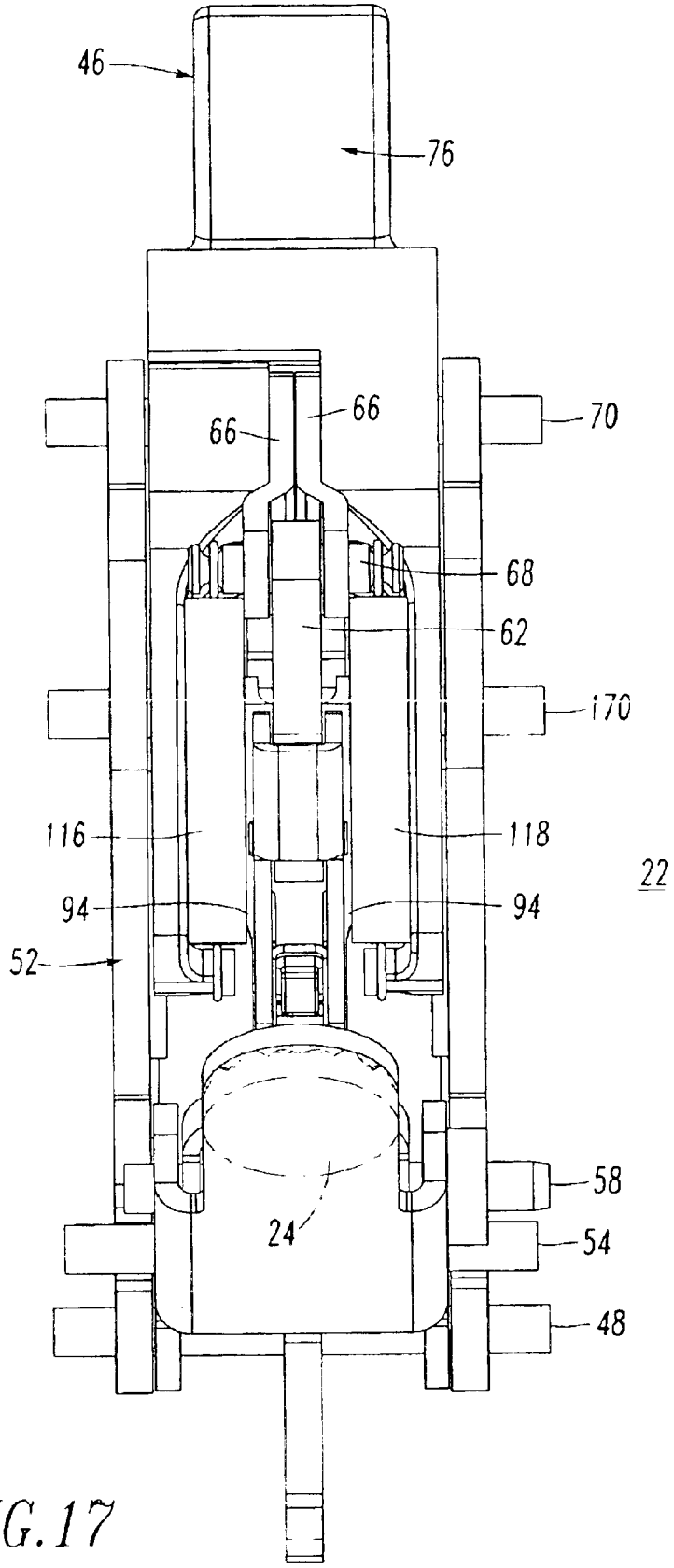
FIG. 17 is a vertical side elevation view of the operating mechanism of FIG. 16.

Referring to FIGS. 16 and 17, the operating mechanism 22 includes various pins and fasteners including: (1) the frame/handle pin 70, (2) a frame/snap lever pin 170, (3) the pin 54 in the movable contact arm 26, (4) the frame/movable contact arm pin 48, (5) the link/spring pin 68 for the independent handle links 66 and the catch link 62, (6) the catch/U-link fastener 172 (FIG. 18), and (7) the U-link/movable contact arm pin 58. On the right side of FIG. 17, the pin 58 is extended on that side for assembly purposes. The pins 70, 170 and 48 are mounted in corresponding openings (not shown) of the two half-cases 12,14 of FIG. 1. The pin 54 provides an overtravel stop for the open position of the separable contacts 40. As best shown in FIG. 17, the pin 54 is somewhat shorter in length than the pins 70, 170 and 48.

Figure 19:
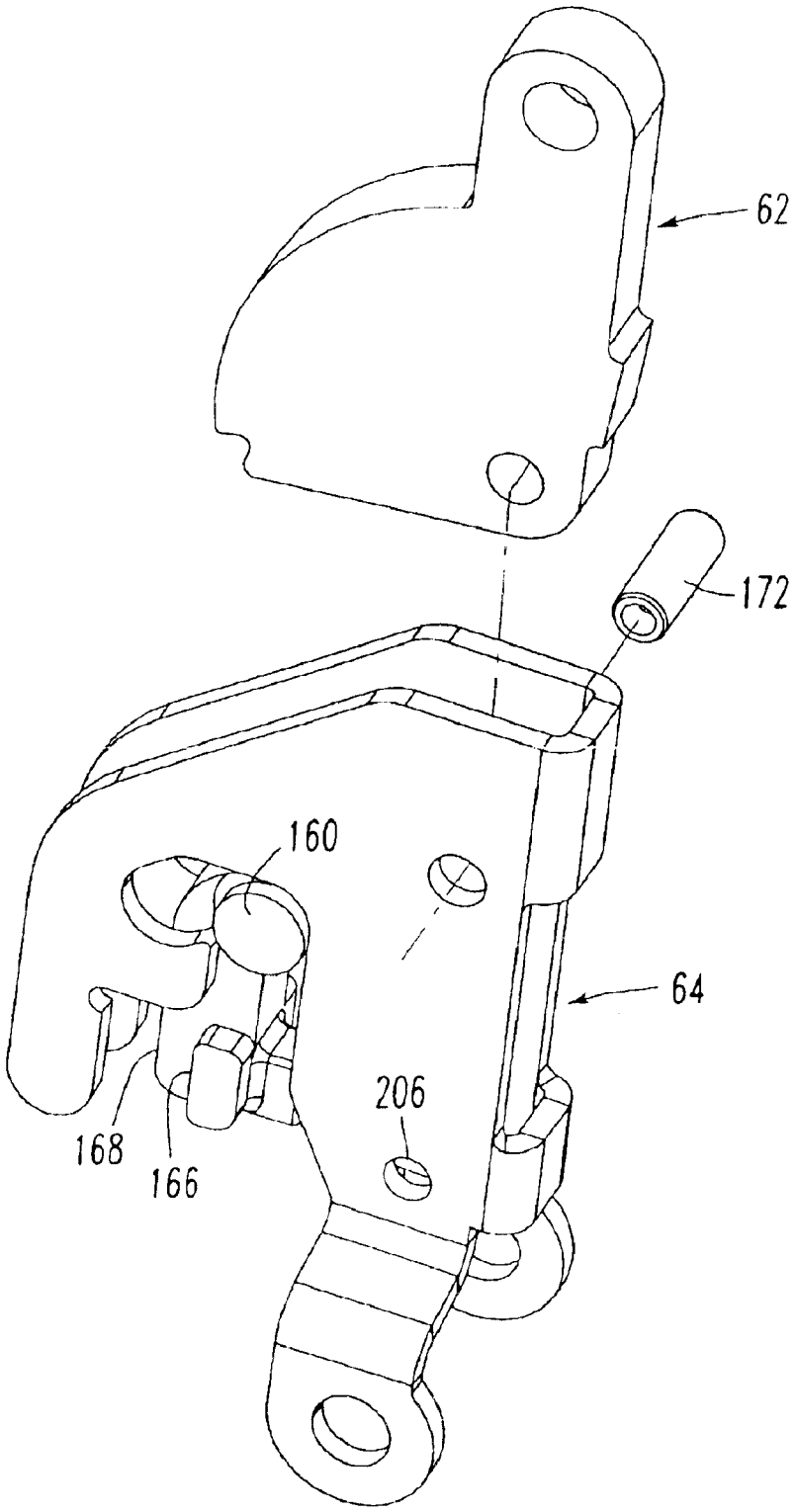
FIG. 19 is an exploded isometric view similar to that shown in FIG. 18, but with the lock being moved through the cutout of the U-link.

FIGS. 18–21 show the linkage mechanism 38 of FIG. 2 including the linkage or collapsible toggle assembly 60 and the lock 90 of FIGS. 18–20, and a spring member, such as the exemplary lock bias wire form 180 of FIG. 21. The toggle assembly 60 includes the toggle catch link 62, the U-link 64 having a base 182 and the parallel legs 65, and the catch/U-link fastener 172. As shown in FIG. 20, the lock 90 is pivotally mounted to and is substantially between the U-link legs 65. The catch link 62 is pivotally mounted by the catch/U-link fastener 172 between the U-link legs 65. The lock 90 is preferably made of a Zamak casting, although any suitable material and manufacturing method may be employed. The catch link 62 and the U-link 64 have a first or unbroken state (FIG. 20) in the closed position (FIG. 5) of the operating mechanism 22, and a second or broken state in the tripped open position of FIG. 6. The lock 90 maintains the unbroken state in the closed position when its latch surface 158 engages and holds the mating surface 159 (FIG. 18) of the catch link 62. The catch 89 of the trip mechanism 98 of FIG. 2 forms a member having a surface 184, which engages the trip surface 168 of the lock 90. In turn, the lock 90 pivots counterclockwise (with respect to FIGS. 18–20), thereby causing the latch surface 158 to release the mating surface 159 of the catch link 62, which releases the links 62,64 to the broken state in the tripped open position. The catch link 62 is preferably made of a die cast material and the U-link 64 is preferably made of stainless steel, although any suitable materials may be employed.

The U-link base 182 and legs 65 form a U-shape, with each of such legs including a cutout portion 186, a pivot portion 188 and a stop portion 190. As sequentially shown by FIGS. 18, 19 and 20, the lock 90 passes through the leg cutout portions 186 before each one of the ears 160,162 of the lock 90 pivotally engages a corresponding one of the leg pivot portions 188 of the U-link 64.

As shown in FIGS. 14 and 20, the stop surfaces 166 of the lock 90 are opposite the protrusion 164, with each one of the stop surfaces 166 engaging the corresponding stop portion 190 of the U-link legs 65. One of the legs 65 is cut away in FIG. 20 to show the mating surface 159 of the catch link 62 engaging the latch surface 158 of the lock 90, in order to maintain the unbroken state of the links 62,64 in the closed position of the operating mechanism 22. The surface 184 of the trip catch 89 engages the lock trip surface 168 (FIG. 18) to pivot the lock 90 about the leg pivot portions 188 of the U-link 64. This disengages the lock latch surface 158 from the catch link mating surface 159 and releases the links 62,64 to the broken state in the tripped open position.

As shown in FIGS. 2 and 21, the lock bias wire form 180 includes a first end 196 and a second end 198, which engages the lock 90 at about the protrusion 164 thereof, in order to keep the wire form 180 from sliding off the lock 90 and to hold such lock pivotally in place between the U-link legs 65. This wire form 180 also keeps the lock 90 firmly up against the U-link stop portions 190. The lock bias spring 180 is generally disposed between the U-link legs 65 of FIG. 18. A pivot 199 is formed by the frame/movable contact arm pin 48. The spring first end 196 engages the pivot 199 and the spring second end 198 engages the lock 90. The spring first end 196 includes a pair of legs 202,204. The U-link legs 65 include openings 206 (only one opening is shown), with each of the spring legs 202,204 passing through a corresponding one of openings 206 and engaging the pivot 199.

The spring 180 is preferably formed from a suitable wire 210 including a first L-shaped portion 212 forming the first leg 202, a U-shaped portion 214 forming the spring second end 198, and a second L-shaped portion 216 forming the second leg 204. Each of the first and second L-shaped portions 212,216 has a leg portion 218 and a foot portion 220, with each of the foot portions 220 passing through a corresponding one of the openings 206 of the U-link legs 65. The U-shaped portion 214 has a base 222, which engages the lock 90, and also has a pair of legs 224,226. Each of these legs 224,226 is coextensive with and forms a bend portion 228 with a corresponding one of the legs 202,204 of the spring first end 196. The bend portions 228 engage the pivot 199 of FIG. 2.

Figure 25:
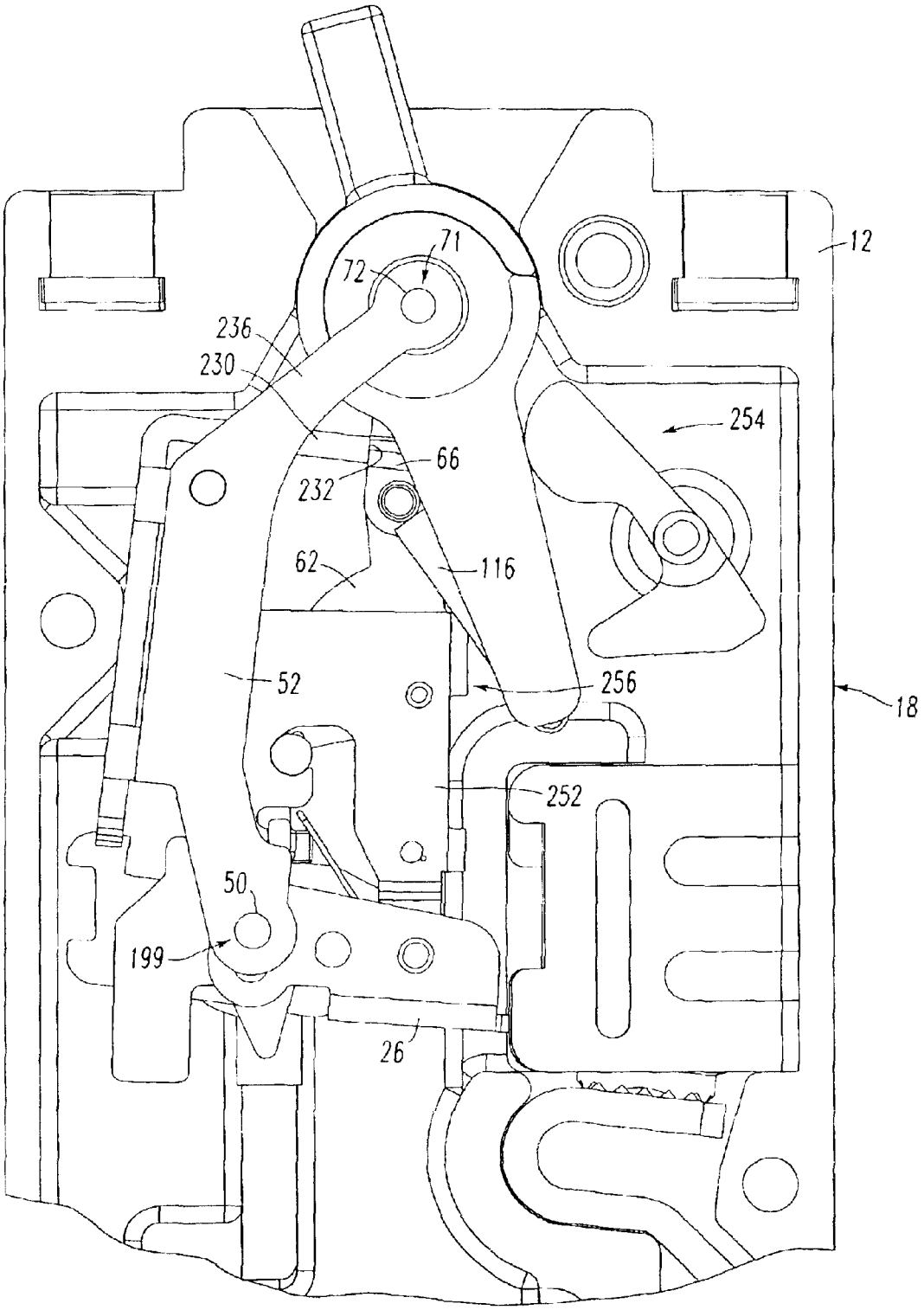
FIG. 25 is a partial vertical elevation view of an operating mechanism similar to that of FIG. 5, but including the U-link of FIG. 24, with the operating handle being moved from the closed position toward the open position as shown prior to the open position.

Referring to FIGS. 22, 23, 25 and 26, the frame 52 of FIG. 2 is shown. The frame 52 is fixedly disposed within the case 18 and includes a tab or stop 230, a stop surface 232, a base 234, and two parallel sides 236,238. The tab 230 engages and stops movement of the independent handle links 66 in the closed position (FIG. 5) as best shown in FIG. 25. The tab 230 is attached to the base 234 and is disposed between the parallel sides 236,238. The tab 230 has a first end 240 and a second end 242, with the first end 240 being disposed from the base 234 and between the parallel sides 236,238, and the second end 242 engaging and stopping movement of the independent handle links 66 in the closed position. The second end 242 has the stop surface 232, which is parallel to the base 234, and which engages and stops movement of the independent handle links 66 in the closed position. The frame 52 further includes the openings 50 for the pivot 199 and the openings 72 for the pivot 71 of FIG. 2, with the movable contact arm 26 being pivotally mounted to the pivot 199. The two parallel sides 236,238 have a first end 246 and a second end 248. The operating handle 46 is pivotally mounted to the first end 246. The movable contact arm 26 is pivotally mounted to the second end 248. Each of the frame sides 236,238 has the stop surface 56. As shown in FIG. 2, the pin 54 of the movable contact arm 26 engages these stop surfaces 56 in the open position of the operating mechanism 22.

Figure 24:
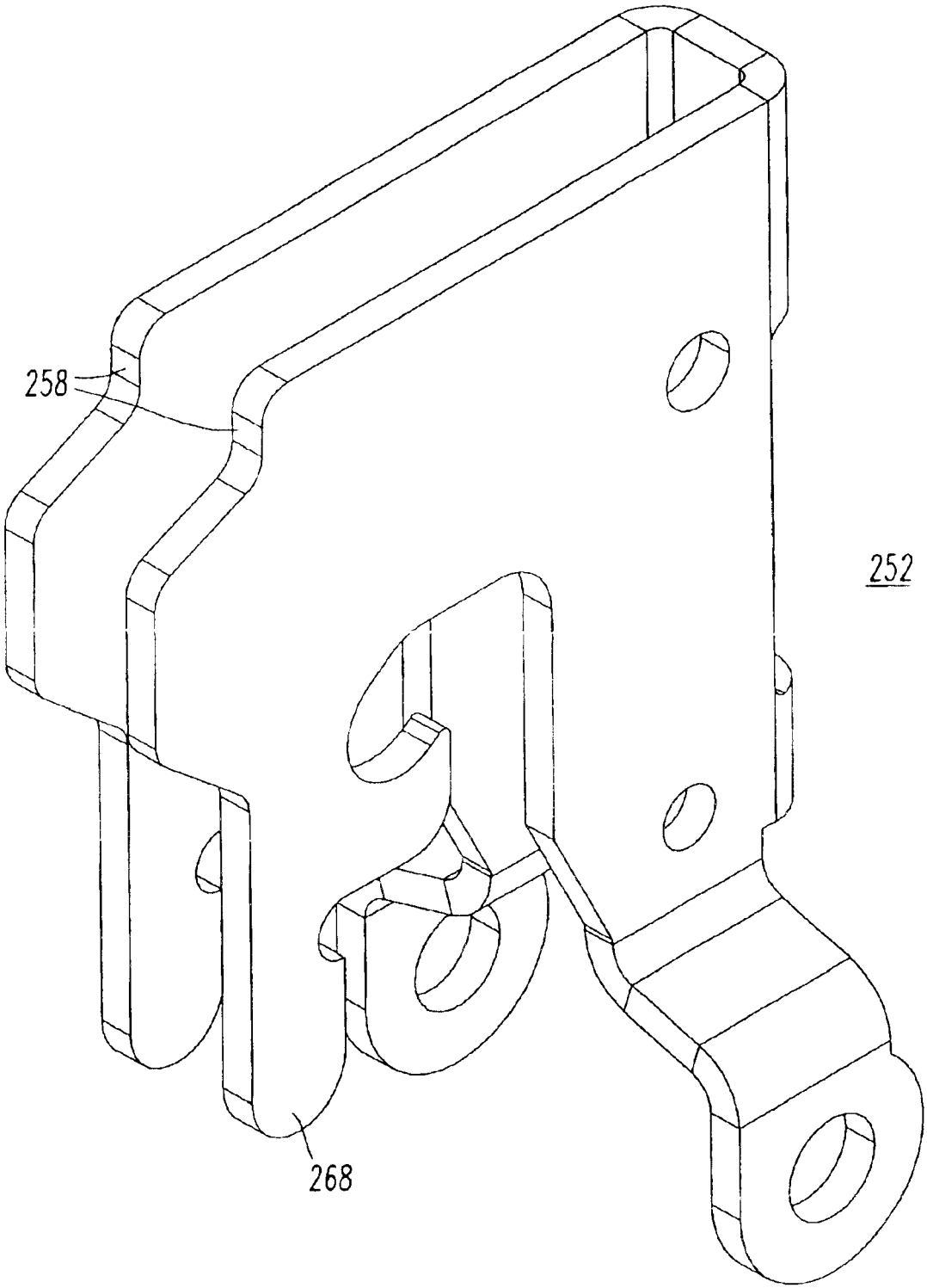
FIG. 24 is an isometric view of a U-link in accordance with another embodiment of the invention.
Figure 26:
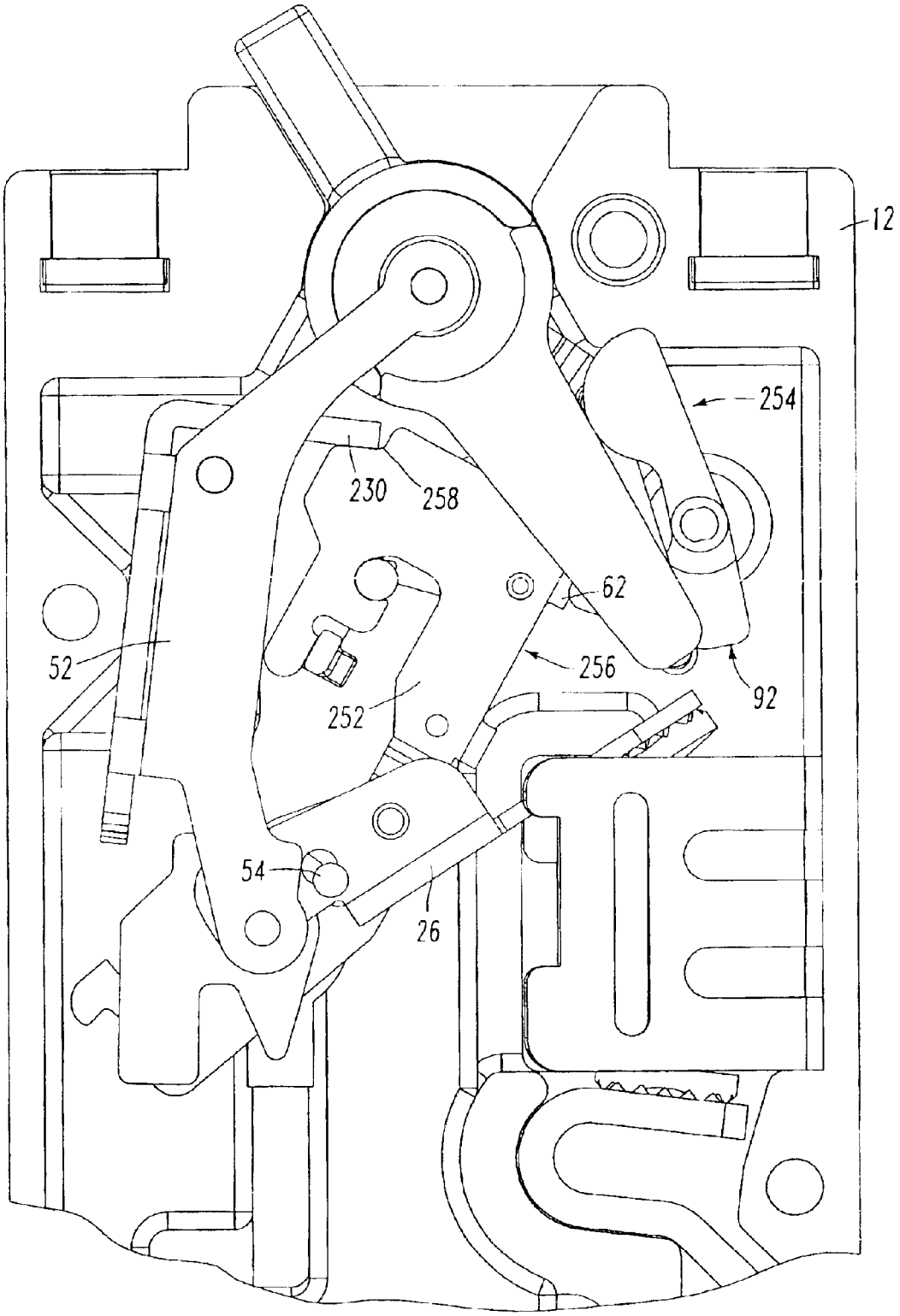
FIG. 26 is a partial vertical elevation view similar to that shown in FIG. 25, but with the operating mechanism being shown in the open position.

FIGS. 24–26 show an alternative U-link 252 and a corresponding operating mechanism 254. Except for the addition of the U-link 252 in place of the U-link 64 of FIG. 2, the operating mechanism 254 is similar to the operating mechanism 22. The U-link 252 and the catch link 62 form a linkage 256. The U-link 252 includes a protrusion 258, with the tab 230 of the frame 52 engaging the protrusion 258 and stopping movement of the linkage 256 in the open position (FIG. 26). Unlike the U-link 64 of FIG. 2, the protrusion 258 of the U-link 252 engages the frame tab 230 and stops movement of the linkage 256 in the open position (FIG. 26), thereby preventing overtravel of the movable contact arm 26. The protrusion 258 also biases the U-link 252 and the catch link 62, in order that when the circuit breaker is tripped, the links 62,252 collapse the appropriate way. Otherwise, if these links collapse the wrong way (i.e., an acute angle facing to the right of FIG. 26), the reset lever 92 would not function properly.

Figure 3:
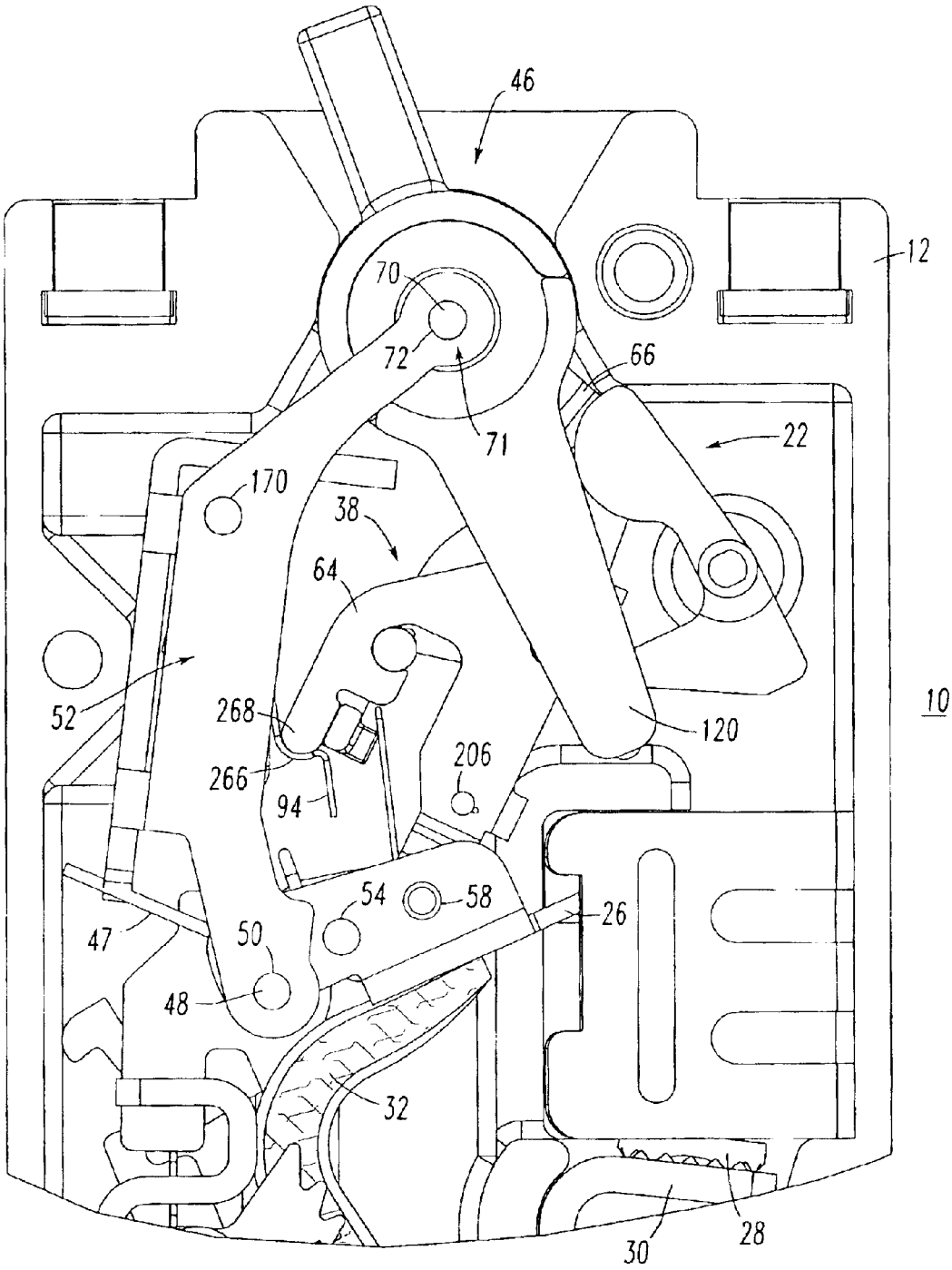
FIG. 3 is a partial vertical elevation view similar to that shown in the upper portion of FIG. 2, but with the operating handle being moved from the open position toward the closed position.

The sequence of closing the separable contacts 40 for the operating mechanisms 22,254 is shown by the transition from FIG. 2 (the operating handle 46 and the operating mechanism 22 both being in the corresponding open positions), to FIG. 3 (the operating handle 46 being moved from the open position toward the closed position, and the operating mechanism 22 being in the open position), to FIG. 4 (the operating handle 46 being moved relatively further toward the closed position, as shown just prior to the closed position of the separable contacts 40 and just prior to the snap closed position of the operating handle 46, and the operating mechanism 22 being in the open position), to FIG. 5 (the operating handle 46, the separable contacts 40 and the operating mechanism 22 all being in the closed position).

Figure 27:
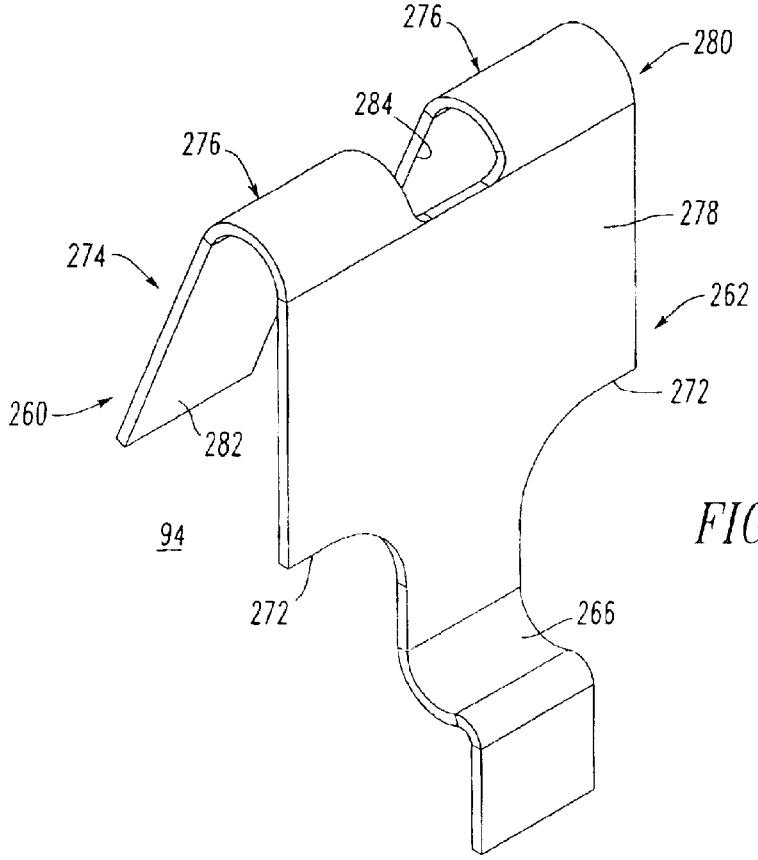
FIG. 27 is an isometric view of the snap lever of FIG. 2.
Figure 29:
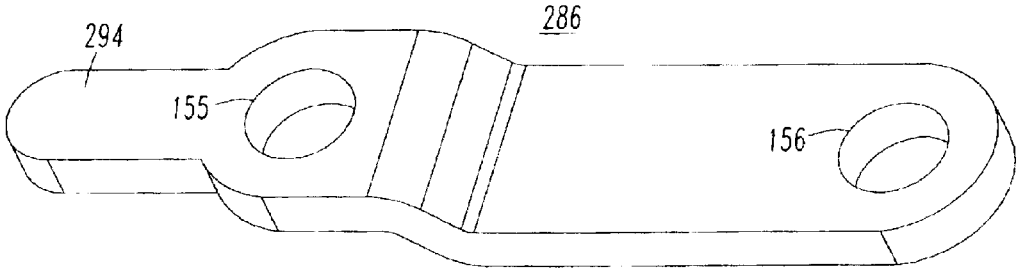
FIG. 29 is an isometric view of an independent handle link in accordance with another embodiment of the invention.

The snap lever 94 of FIG. 2 is best shown in FIG. 27. Functionally, the snap lever 94 holds the movable contact arm 26 in the open position of the separable contacts 40 (FIGS. 2–4) and releases the movable contact arm 26 (between FIGS. 4 and 5) as the operating handle 46 moves from the open position (FIG. 2) toward the closed position (FIG. 5) thereof. This release position is the snap closed position of the operating handle 46. When the operating handle 46 reaches this position, the load of the extension springs 116,118 is released as a snap close action. In particular, the snap lever 94 initially holds the linkage 60 (FIG. 18) including the U-link 64 (or the linkage 256 including the U-link 252 of FIG. 25), thereby holding the movable contact arm 26 in the open position of the separable contacts 40. Between the positions of FIGS. 4 and 5, the snap lever 94 releases the linkage 60, U-link 64 and movable contact arm 26 as the operating handle 46 moves from the open position (FIG. 2) toward the closed position (FIG. 5) to the snap closed position. Since the U-link 252 and the operating mechanism 254 function in the same manner as the U-link 64 and the operating mechanism 22 in closing the separable contacts 40, the function of the snap lever 94 is the same for both operating mechanisms 22,254. The snap lever 94 may be employed with any suitable linkage and operating mechanism.

Referring to FIGS. 4, 5 and 27, the snap lever 94 pivots on the frame/snap lever pin 170. The snap lever 94 includes a first end 260 and a second end 262. The first end 260 rests against the frame 52 (part of which is cut away in FIGS. 4 and 5 to show the snap lever 94), in order to provide a spring force to return the snap lever 94 to hold the U-link 64 (as shown in FIG. 3). The snap lever second end 262 includes a surface or cup 266. The U-link 64 further has a knee portion or detent 268, which is captured by the cup 266 (as shown in FIG. 3). In the snap closed position of the operating handle 46 (between FIGS. 4 and 5), surfaces 270 (only one surface is shown) on the elongated arms 120,122 of the operating handle 46 engage surfaces or shoulders 272 of the snap lever 94. In turn, the snap lever second end 262 pivots clockwise (with respect to the pin 170 of FIGS. 4 and 5) and the cup 266 releases the U-link detent 268, thereby permitting the load of the extension springs 116,118 to drive the links 62,64 and, in turn, drive the movable contact arm 26 carrying the movable contact 24 toward the fixed contact 28, in order to snap closed the separable contacts 40. As shown in FIG. 5, the arms 120,122 also compress the snap lever 94, in order to avoid the U-link 64 in the closed position.

Figure 28:
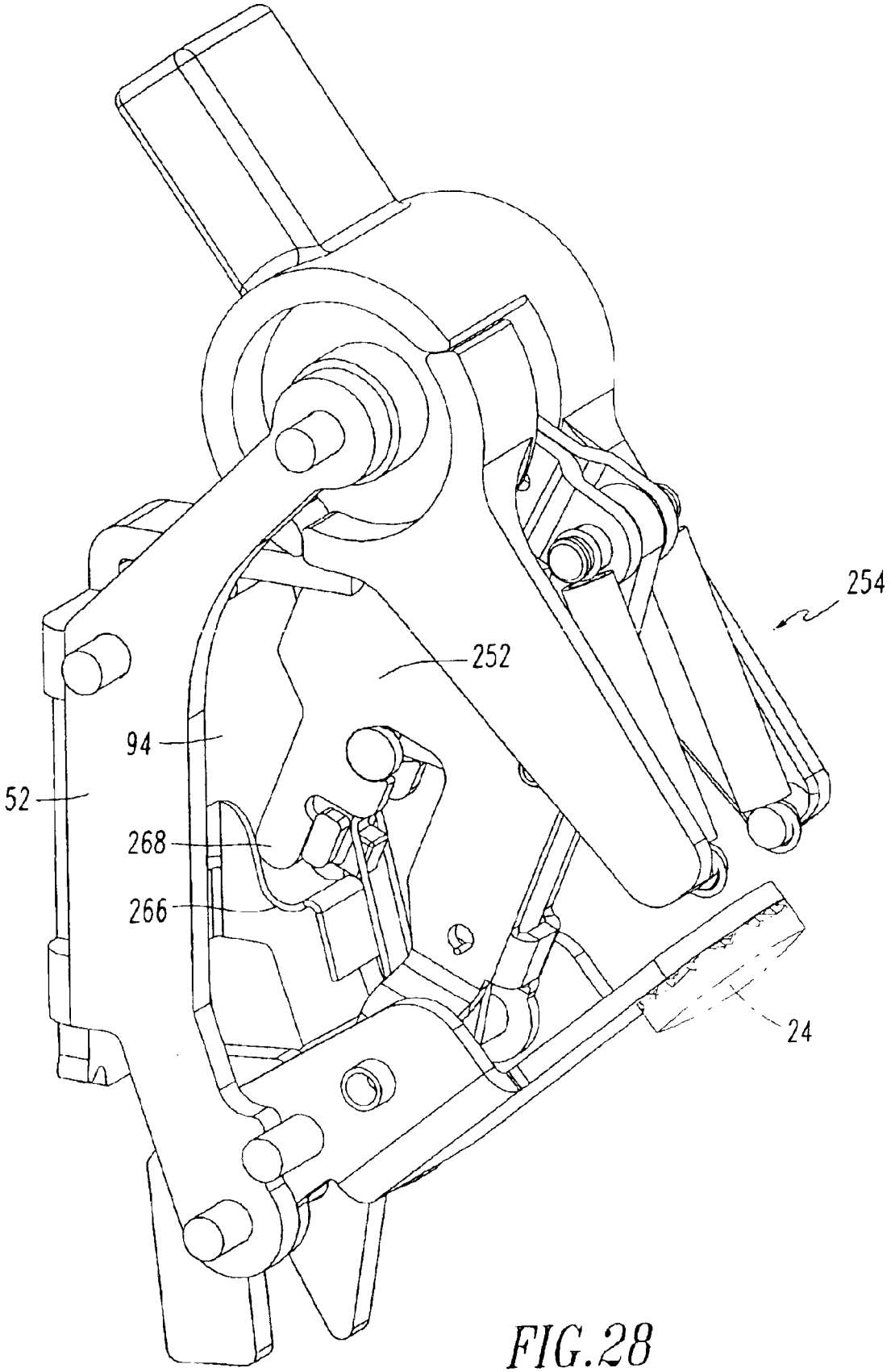
FIG. 28 is an isometric view of the operating mechanism of FIG. 25, but with the operating mechanism being shown in the open position.

FIGS. 2, and 3 and 16 show the transition of the operating mechanism 22 between the open position (FIG. 2) and the capture position (FIGS. 3 and 16) of the operating mechanism 22. FIG. 28 similarly shows the open position of the operating mechanism 254. The capture position prepares the corresponding operating mechanisms 22,254 for a subsequent snap close operation. As the operating handle 46 is moved from the closed position (FIG. 5) to the open position (FIG. 2) of the operating mechanism 22, the U-link detent 268 compresses (as shown in FIG. 2) the snap lever second end 262 toward the snap lever first end 260 (FIG. 27) and the frame 52. Then, as the operating handle 46 moves from the open position (FIGS. 2 and 28) toward the closed position (FIG. 5), the U-link detent 268 moves toward the snap lever cup 266, which captures such U-link detent 268 in the capture position (FIGS. 3 and 16) of the operating mechanism 22.

The exemplary snap lever 94 of FIG. 27 is preferably made of a resilient material, such as spring steel, and is generally V-shaped with a first arm portion 274, a bend portion 276 and a second arm portion 278. The portions 274,278 form a spring mechanism 280, with the second arm portion 278 including the snap lever surfaces 266,272. The first arm portion 274 includes a pair of spring mechanisms, such as parallel arms 282,284, connected to the bend portion 276. The snap lever bend portion 276 is disposed at about the pivot pin 170 (FIGS. 4 and 5), with the first and second arm portions 274,278 disposed on opposite sides of such pin.

FIGS. 29–32 show an alternative independent handle link 286 and operating mechanism 288 including a flexible cantilever lever 290, which is fixed within the case 292. The independent handle link 286 has a projection 294, which engages a first surface 296 of the flexible cantilever lever 290 and holds the link 286 in the open position of the operating mechanism 288. Although two identical links (only one is shown) 286 are employed in order to reduce component count, only one of the links 286 needs the projection 294. As the operating handle 46 moves clockwise (with respect to FIG. 30) from the open position to the closed position, the flexible cantilever lever 290 flexes down (with respect to FIG. 30) and releases the projection 294 of the link 286. Hence, this releases the link 286 and the links 62,64 as the operating handle 46 moves the operating mechanism 288 from the open position (just prior to FIG. 30) toward the closed position (FIG. 31) to the snap closed position (just after FIG. 30).

The flexible cantilever lever 290 delays motion of the independent handle link 286 and the linkage or collapsible toggle assembly 60 formed by the links 62,64. This allows the extension springs 116 and 118 (as shown in FIG. 16) to extend as the operating handle 46 moves from the open position to the snap closed position of the operating mechanism 288. Hence, this loads the linkage 60 until the flexible cantilever lever 290 flexes and releases the projection 294 of the independent handle link 286. The load of the extensions springs 116,118 is released as a snap close action, in order that such springs drive the linkage 60 and drive the movable contact arm 26 carrying the movable contact 24 toward the fixed contact 28.

Figure 30:
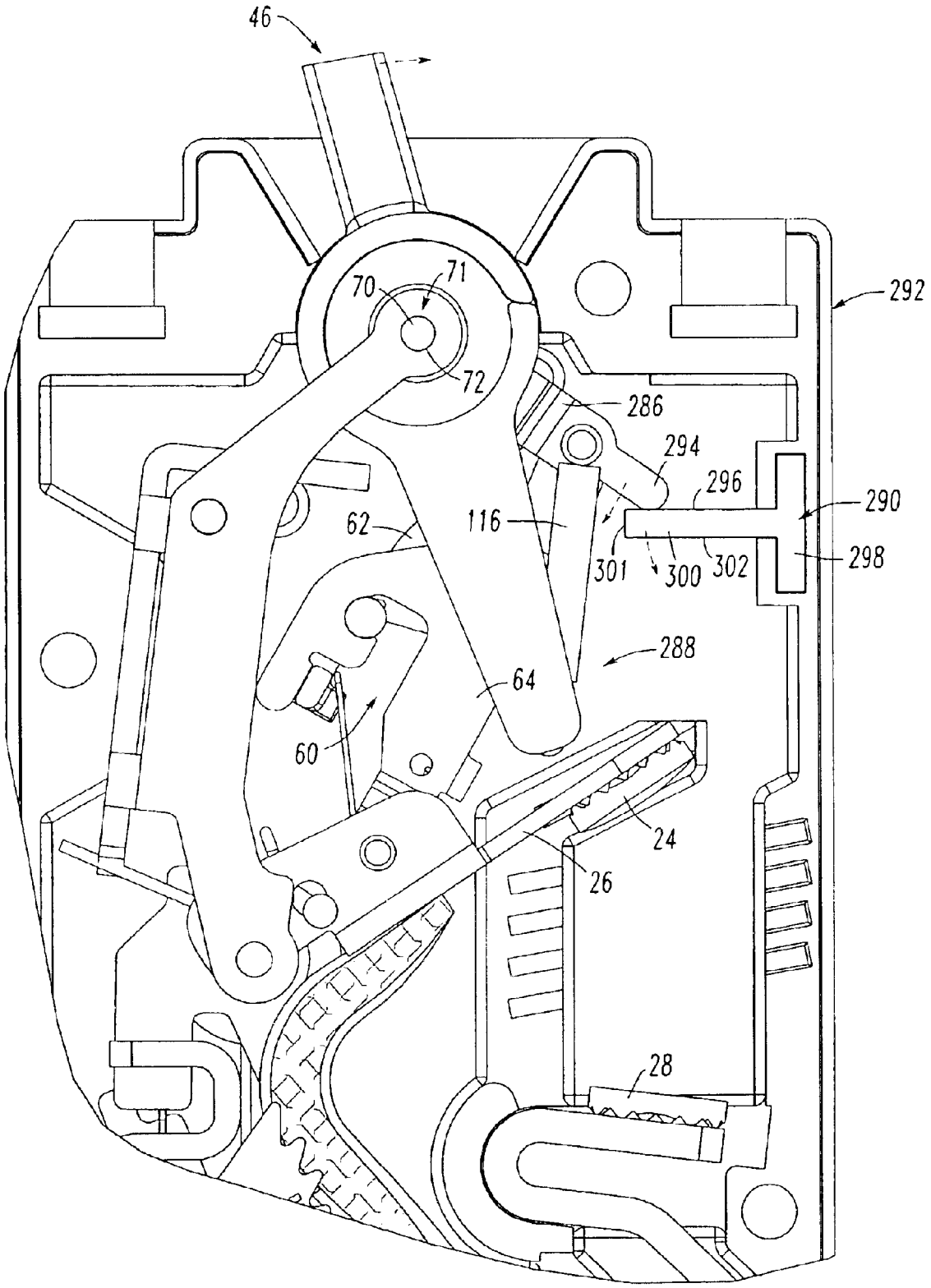
FIG. 30 is a partial vertical elevation view of an operating mechanism similar to that of FIG. 3, but including the independent handle link of FIG. 29, with the operating handle being moved from the open position toward the closed position.

As shown in FIG. 30, the exemplary flexible cantilever lever 290 has an inverted T-shape, with a base portion 298 fixed to the case 292 and a cantilever portion 300 extending within such case. The cantilever portion 300 has a first side with the first surface 296 and an opposite second side with a second surface 302. The independent handle link projection 294 engages the first side and holds the independent handle link 286 in the open position of the operating mechanism 288. As the operating handle 46 moves the operating mechanism 288 from the open position toward the closed position, the link projection 294 will begin by contacting the side 296 of the flexible cantilever lever 290. As the links 286,62,64 move, they cause the cantilever lever 290 to deform downward with respect to FIG. 30 and the projection 294 slides along the side 296 until it gets to the end surface 301. There will be, possibly, some contact with the end surface 301 as the projection 294 leaves contact and the cantilever lever 290 springs back upward to the horizontal position of FIG. 30.

Figure 32:
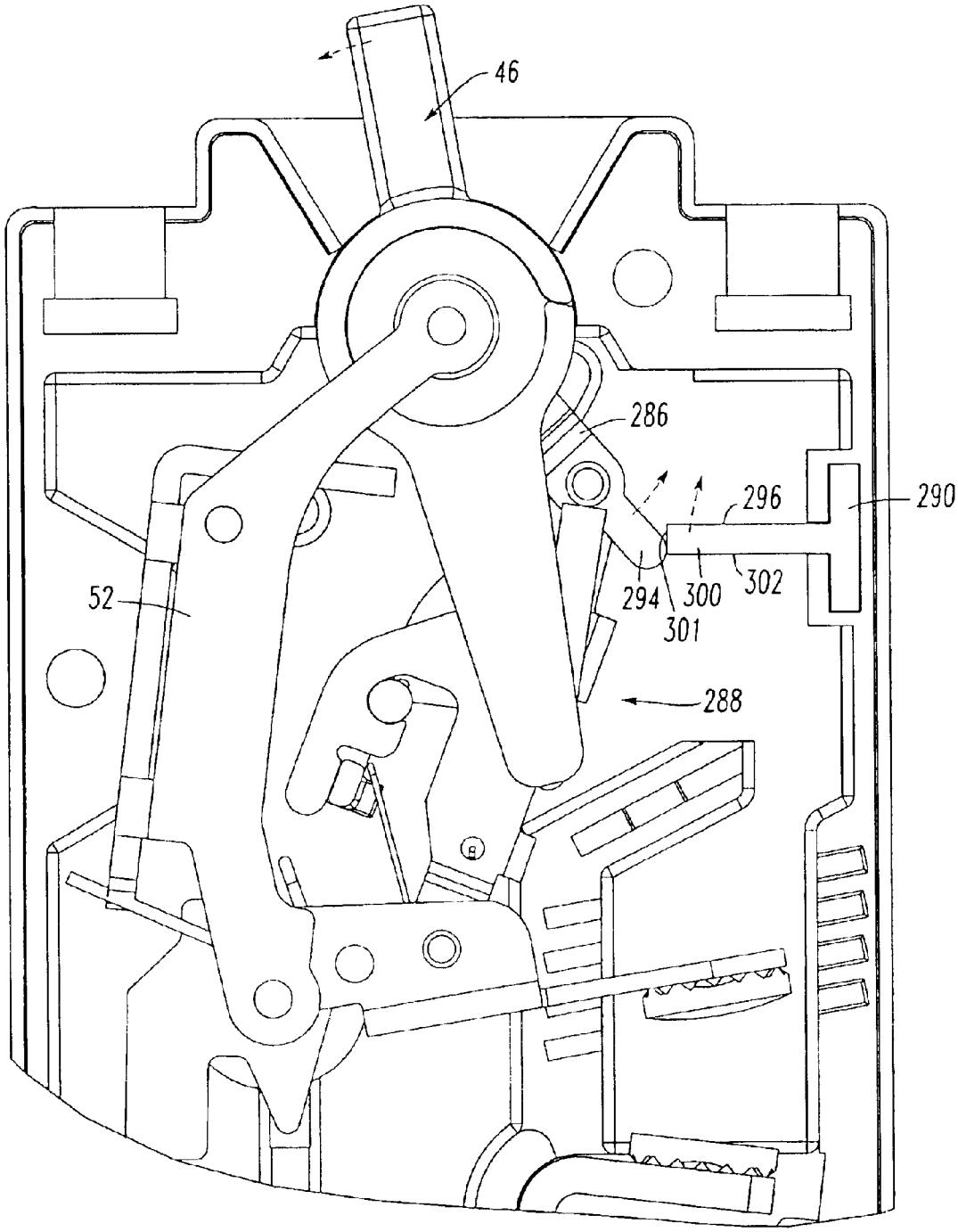
FIG. 32 is a partial vertical elevation view similar to that shown in FIG. 31, but with the operating handle being moved from the closed position toward the open position.

Referring to FIG. 32, conversely, as the operating handle 46 moves from the closed position toward the open position, the cantilever portion 300 flexes (upward with respect to FIG. 32) and eventually releases the projection 294. Other than the addition of the flexible cantilever lever 290 and the independent handle link 286, and the removal of the independent handle link 66, the snap lever 94, and the reset lever 92, the operating mechanism 288 is similar to the operating mechanism 22 of FIG. 2.

Since the operating mechanism 288 does not employ the reset lever 92, another suitable reset mechanism is employed to reset the links 62,64 from their broken state (not shown) to the unbroken state (FIG. 30). Here, the flexible cantilever lever 290 is advantageously employed to latch the links 62,64 in place.

While not shown, a position indicator, such as a steel stamping, may be suitably attached to the movable contact arm 26 of FIG. 2. The position indicator may include, for example, a permanent magnet (not shown). A Hall probe (not shown) may be mounted on the outside of the circuit breaker 10. The Hall probe senses the permanent magnet and, thus, indicates the open or closed positions of the movable contact arm 26.

The present frame 52 and tab 230 provide suitable room for the snap lever 94. This prevents the operating mechanisms 22,254 from traveling too far in the closed position. The frame 254 and U-link 252 also prevent the movable contact arm 26 from interfering with the elongated operating handle arms 120,122 and the extension springs 116,118 in the open position. The protrusion 258 of the U-link 252 is also engaged and stopped by the tab 230, in order to stop movement of such link in the open position and preclude the operating mechanism 254 from becoming jammed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a case;

a frame fixedly disposed within said case, said frame including a stop;

separable contacts; and an operating mechanism for opening and closing said separable contacts, said operating mechanism including an operating handle, a closed position, an open position, a linkage having a first end and a second end, and a link pivotally mounted to said case and to the first end of said linkage, the stop of said frame engaging and stopping movement of said link in said closed position.

2. The circuit breaker of claim 1 wherein said separable contacts include a fixed contact and a movable contact; wherein said operating mechanism further includes a movable contact arm carrying said movable contact; and wherein the second end of said linkage is pivotally mounted to said movable contact arm, said linkage moving said movable contact arm to provide the closed and open positions of said operating mechanism.

3. The circuit breaker of claim 1 wherein said frame further includes a base and two parallel sides, with said stop attached to said base and being disposed between said parallel sides.

4. The circuit breaker of claim 3 wherein said operating handle includes a pair of elongated arms within said case, said arms being disposed between the parallel sides of said frame, said stop and said link being disposed between said elongated arms; and wherein said operating mechanism further includes a pair of extension springs and a pivot between said link and the first end of said linkage, with each one of said extension springs extending between a corresponding one of said elongated arms and said pivot.

5. The circuit breaker of claim 1 wherein said linkage includes a protrusion; and wherein said stop engages the protrusion of said linkage and stops movement of said linkage in said open position.

6. A circuit breaker comprising:

a case;

frame fixedly disposed within said case, said frame including a tab;

separable contacts; and an operating mechanism for opening and closing said separable contacts, said operating mechanism including an operating handle, a closed position, an open position, a first link having a first end and a second end, a second link pivotally mounted to the second end of said first link, and a third link pivotally mounted to said case and to the first end of said first link, the lab of said frame engaging and stopping movement of said third link in said closed position.

7. The circuit breaker of claim 6 wherein said frame further includes a base and two parallel sides, with said tab disposed from said base and between said parallel sides.

8. The circuit breaker of claim 7 wherein said operating handle includes a pair of elongated arms within said case, said arms being disposed between the parallel sides of said frame, said tab and said third link being disposed between said elongated arms.

9. The circuit breaker of claim 8 wherein said operating mechanism further includes a pair of extension springs and a pivot between said third link and the first end of said first link, with each one of said extension springs extending between a corresponding one of said elongated arms and said pivot.

10. The circuit breaker of claim 6 wherein said tab has a first end and a second end with a surface which is parallel to said base, with said surface of the second end of said tab engaging and stopping movement of said third link in said closed position.

11. The circuit breaker of claim 6 wherein said second link includes a protrusion; and wherein said tab engages the protrusion of said second link and stops movement of said second link in said open position.

12. The circuit breaker of claim 6 wherein said case has an opening; wherein said operating mechanism further includes a pivot between said first and third links, at least one extension spring for moving said operating mechanism to close said separable contacts, and an operating handle for operating said operating mechanism, said operating handle including a first portion extending through the opening of said case and a second portion within said case, said at least one extension spring extending between said second portion and said pivot.

13. The circuit breaker of claim 12 wherein said operating mechanism further includes a movable contact arm; and wherein said first link is pivotally mounted to said pivot at the first end of said first link, said second link having a first end and a second end, said second link being pivotally mounted to the second end of said first link at the first end of said second link and being pivotally mounted to said movable contact arm at the second end of said second link.

14. The circuit breaker of claim 13 wherein said operating handle has an open position and a closed position, said at least one extension spring being extended as said operating handle moves from the open position toward the closed position thereof, in order to load the first and second links of said operating mechanism; and wherein said separable contacts have a closed position and an open position, said separable contacts including a fixed contact, which is fixed within said case, and a movable contact, which is carried by said movable contact arm.

15. The circuit breaker of claim 14 wherein said pivot is a first pivot; wherein said third link has a first end and a second end; wherein said operating handle further includes a second pivot between said first and second portions, said third link being pivotally mounted to said second pivot at the first end of said third link and being pivotally mounted to said first pivot at the second end of said third link; and wherein said at least one extension spring applies a force to move said third link.

16. The circuit breaker of claim 15 wherein said frame further includes an opening for said second pivot.

17. The circuit breaker of claim 16 wherein said frame further includes an opening for a third pivot; and wherein said movable contact arm is pivotally mounted to said third pivot.

18. The circuit breaker of claim 6 wherein said operating mechanism further includes a fourth link in parallel with said third link, said fourth link being pivotally mounted to the first end of said first link.

19. The circuit breaker of claim 6 wherein said frame further includes a base and two parallel sides having a first end and a second end, with said tab attached to said base and being disposed between said parallel sides; and wherein said operating mechanism further includes an operating handle pivotally mounted to the first end of the parallel sides of said base, and a movable contact arm pivotally mounted to the second end of said parallel sides.

20. The circuit breaker of claim 6 wherein said circuit breaker is a telecommunication circuit breaker.

21. The circuit breaker of claim 6 wherein said separable contacts include a fixed contact and a movable contact; wherein said operating mechanism further includes a movable contact arm carrying said movable contact; wherein said second link has a first end and a second end, the first end of said second link being pivotally mounted to the second end of said first link, the second end of said second link being pivotally mounted to said movable contact arm, said second link moving said movable contact arm to provide the closed and open positions of said operating mechanism; wherein said frame includes a base and two sides, each of the sides of said frame having a surface; and wherein said movable contact arm includes a pin which engages the surfaces of the sides of said frame in the open position of said operating mechanism.

* * * * *